US010487703B2

(12) United States Patent
Moriarty

(10) Patent No.: US 10,487,703 B2
(45) Date of Patent: Nov. 26, 2019

(54) ROTARY VALVE ENGINE SYSTEM

(71) Applicant: David J. Moriarty, Macomb Township, MI (US)

(72) Inventor: David J. Moriarty, Macomb Township, MI (US)

(73) Assignee: RVD Enterprises, LLC, Farmington Hills, MI (US)

( * ) Notice: Subject to any disclaimer, the term of this patent is extended or adjusted under 35 U.S.C. 154(b) by 0 days.

(21) Appl. No.: 15/331,227

(22) Filed: Oct. 21, 2016

(65) Prior Publication Data

US 2017/0114678 A1 Apr. 27, 2017

Related U.S. Application Data

(60) Provisional application No. 62/244,343, filed on Oct. 21, 2015.

(51) Int. Cl.

| | |
|---|---|
| ***F01L 7/02*** | (2006.01) |
| ***F01L 7/14*** | (2006.01) |
| ***F01L 7/16*** | (2006.01) |
| ***F01L 1/02*** | (2006.01) |

(Continued)

(52) U.S. Cl.

CPC ..... *F01L 7/026* (2013.01); *F01L 7/021* (2013.01); *F01L 7/14* (2013.01); *F01L 7/16* (2013.01); *F01L 1/022* (2013.01); *F01L 1/024* (2013.01); *F01L 7/18* (2013.01); *F01L 2101/00* (2013.01); *F01L 2101/02* (2013.01); *F01L 2113/00* (2013.01); *F01L 2250/02* (2013.01); *F01L 2250/04* (2013.01); *F02F 1/4285* (2013.01)

(58) Field of Classification Search

CPC ..... F01L 7/026; F01L 7/18; F01L 7/14; F01L 7/16; F01L 2113/00; F01L 1/022; F01L 1/024; F02F 1/4285

See application file for complete search history.

(56) References Cited

U.S. PATENT DOCUMENTS 5,361,739 A * 11/1994 Coates ..... F01L 7/026 123/190.14

2005/0103303 A1* 5/2005 Wright ..... F01L 7/02 123/190.5

OTHER PUBLICATIONS

The Evolution of the Internal Combustion Engine, Technology, CSRV System Advantages [online]. Coates International, 2011 [retrieved on Feb. 14, 2018]. Retrieved from the Internet: <URL: http://www.coatesengine.com/csrv-system.html>.

* cited by examiner

*Primary Examiner* — Jacob M Amick
*Assistant Examiner* — Charles Brauch
(74) *Attorney, Agent, or Firm* — Preston Smirman; Smirman IP Law, PLLC

(57) ABSTRACT

A cylinder head assembly for a cylinder of a four stroke internal combustion engine, including an intake rotor assembly that includes an intake rotor body, a first intake rotor shell portion, and a second intake rotor shell portion, and is operable to be rotatably received in at least one through bore of a cylinder head member. An exhaust rotor assembly includes an exhaust rotor body, a first exhaust rotor shell portion, and a second exhaust rotor shell portion, and is operable to be rotatably received in the at least one through bore of the cylinder head member. At least one of the first and second intake rotor shell portions or the first and second exhaust rotor shell portions are operable to be urged out- (Continued)

wardly towards or against an interior surface of the at least one through bore of the cylinder head member so as to create a seal therebetween.

20 Claims, 18 Drawing Sheets

(51) Int. Cl.
*F02F 1/42* (2006.01)
*F01L 7/18* (2006.01)

ROTARY VALVE ENGINE SYSTEM

CROSS REFERENCE TO RELATED APPLICATION

The instant application claims priority to U.S. Provisional Patent Application Ser. No. 62/244,343, filed Oct. 21, 2015, the entire specification of which is expressly incorporated herein by reference.

FIELD OF THE INVENTION

The present invention generally relates to rotary valve internal combustion engine systems, and more specifically, to new and improved rotary valve internal combustion engine systems that include rotor shell assemblies that are selectively operable to be urged outwardly against an interior wall surface of a hollow tubular housing by vacuum and/or positive pressure generated in a combustion chamber of an engine cylinder during an intake and/or compression stroke and/or combustion gases emanating from a combustion chamber of an engine cylinder during a power and/or exhaust stroke.

BACKGROUND OF THE INVENTION

Rotary valve internal combustion engines possess several significant advantages over conventional poppet valve internal combustion engines, including significantly higher compression ratios and revolutions per minute (RPM), meaning more power, a much more compact and light-weight cylinder head, and reduced complexity, thus potentially leading to higher engine reliability and lower maintenance and/or repair costs.

Rotary valves are potentially highly suitable for high-revving internal combustion engines, for example, such as those used in racing sports cars and Formula One (F1) racing cars, on which traditional poppet valves with springs can fail due to valve float and spring resonance and where the desmodromic valve gear is too heavy, large in size and too complex to time and design properly. As previously noted, rotary valves could allow for a more compact and light-weight cylinder head design, which is an important design consideration for sports cars and racing cars. These types of valves typically rotate at half engine speed and lack the inertia forces of reciprocating valve mechanisms. This allows for higher engine speeds and potentially offers significantly more power than conventional poppet valve internal combustion engines.

Conventional rotary valve internal combustion engines typically employ a cylinder head that includes a rotary valve mechanism that allows an incoming air/fuel charge into the particular cylinder of the engine and any resulting combustion gases out of the cylinder through an exhaust rotary valve mechanism into an exhaust manifold or header. These conventional rotary valve internal combustion engines typically include a seal, for example, of various shapes and sizes, that seals against a rotary valve rotor to prevent combustion gases and pressure from escaping out of the combustion chamber. The seal also presumably prevents any leakage of any incoming air and fuel coming into the combustion chamber from the intake manifold, as well as any outgoing exhaust gases exiting from the combustion chamber. The rotary valve seal is stationary and the rotary valve face is constantly rubbing against this seal (e.g., during each successive rotation), wearing both the rotor surface and seal face where these parts are in constant contact with one another. This "static" type of seal is sometimes pressed into the cylinder head itself and the rotary valve rotor rests directly on top of the seal to contain the combustion gases and pressures, and to seal off any path into and out of the combustion chamber for both the intake and exhaust manifolds.

Some of the problems associated with these types of seal designs are the constant wearing and friction that exists between these parts, the mechanical losses because of the friction that exists there, and, because of this constant contact, the rotor seal wearing out and eventually allowing the combustion gases to leak out and prevent complete combustion within the cylinder. Rotary valve engine designers have tried numerous different rotor seal design iterations, and materials used therefor, only to have the same constant contact wear and leakage issues to deal with (sometimes very quickly) because of this static type of seal design.

Accordingly, there exists a need for new and improved rotary valve internal combustion engine systems that overcome at least one of the aforementioned deficiencies.

SUMMARY OF THE INVENTION

In accordance with the general teachings of the present invention, new and improved rotary valve internal combustion engine systems are provided that include rotor shell assemblies that are selectively operable to be urged outwardly against an interior wall surface of a hollow tubular housing by vacuum and/or positive pressure generated in a combustion chamber of an engine cylinder during an intake and/or compression stroke and/or combustion gases emanating from a combustion chamber of an engine cylinder during a power and/or exhaust stroke.

In accordance with a first embodiment of the present invention, a cylinder head assembly for a cylinder of a four stroke internal combustion engine is provided, comprising:

a cylinder head member, wherein the cylinder head member includes a first area defining a first exhaust port and a first intake port formed on an upper surface thereof, and a second area defining a second exhaust port and a second intake port formed on a lower surface thereof;

wherein the cylinder head member includes an area defining a through bore, wherein the first and second exhaust ports are axially aligned with one another and are in fluid communication with the through bore, wherein the first and second intake ports are axially aligned with one another and are in fluid communication with the through bore;

an intake rotor assembly including an intake rotor body, a first intake rotor shell portion, a second intake rotor shell portion, wherein the intake rotor assembly is operable to be rotatably received in the through bore of the cylinder head member;

wherein the intake rotor body includes an area defining a through bore extending therethrough, wherein the through bore of the intake rotor body includes a first open end and a spaced and opposed second open end, wherein the first and second intake rotor shell portions are operable to envelope a portion of the intake rotor body such that an air gap is formed between the first and second intake rotor shell portions, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions are operable to jointly rotate so that the first and second open ends of the through bore of the intake rotor body and the ports of the first and second intake rotor shell portions are in fluid communication with the first and second intake ports; and an exhaust rotor assembly including an exhaust rotor body, a first exhaust rotor shell portion, a second exhaust rotor shell portion, wherein the exhaust rotor assembly is operable to be rotatably received in the through bore of the cylinder head member;

wherein the exhaust rotor body includes an area defining a through bore extending therethrough, wherein the through bore of the exhaust rotor body includes a first open end and a spaced and opposed second open end, wherein the first and second exhaust rotor shell portions are operable to envelope a portion of the exhaust rotor body such that an air gap is formed between the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions are operable to jointly rotate so that the first and second open ends of the through bore of the exhaust rotor body and the ports of the first and second exhaust rotor shell portions are in fluid communication with the first and second exhaust ports.

In accordance with one aspect of this embodiment, at least one of the first and second intake rotor shell portions are operable to be urged outwardly towards or against an interior surface of the through bore of the cylinder head member in response to an increase or decrease in pressure of a cylinder in fluid communication with either of the first exhaust port or the first intake port.

In accordance with one aspect of this embodiment, at least one of the first and second intake rotor shell portions are operable to be urged outwardly towards or against an interior surface of the through bore of the cylinder head member in response to a gaseous flow from the cylinder in fluid communication with the first exhaust port or the first intake port, so as to create a seal therebetween.

In accordance with one aspect of this embodiment, at least one of the first and second exhaust rotor shell portions are operable to be urged outwardly towards or against an interior surface of the through bore of the cylinder head member in response to an increase or decrease in pressure of a cylinder in fluid communication with either of the first exhaust port or the first intake port.

In accordance with one aspect of this embodiment, at least one of the first and second exhaust rotor shell portions are operable to be urged outwardly towards or against an interior surface of the through bore of the cylinder head member in response to a gaseous flow from the cylinder in fluid communication with the first exhaust port or the first intake port, so as to create a seal therebetween.

In accordance with one aspect of this embodiment, the intake rotor body and the exhaust rotor body include a shaft extending therefrom.

In accordance with one aspect of this embodiment, a shaft interconnection member is operable to interconnect the shaft of the exhaust rotor body and the shaft of the intake rotor body.

In accordance with one aspect of this embodiment, an interconnection member is operable to interconnect the intake rotor body and the exhaust rotor body such that intake rotor assembly simultaneously rotates with exhaust rotor assembly.

In accordance with a second embodiment of the present invention, a cylinder head assembly for a cylinder of a four stroke internal combustion engine is provided, comprising:

a lower cylinder head member, wherein the lower cylinder head member includes an area defining a first exhaust port and a first intake port formed therein;

an upper cylinder head member, wherein the upper cylinder head member includes an area defining a second exhaust port and a second intake port formed therein;

wherein the lower and upper cylinder head members are operable to be brought into engagement with one another so as to define a through bore therebetween, wherein the first and second exhaust ports are axially aligned with one another when the lower and upper cylinder head members are brought into engagement with one another, wherein the first and second intake ports are axially aligned with one another when the lower and upper cylinder head members are brought into engagement with one another;

a cylindrical housing having an area defining a through bore extending therethrough, wherein a first surface of the housing includes an area defining a third exhaust port and a third intake port formed therein, wherein a spaced and opposed second surface of the housing includes an area defining a fourth exhaust port and fourth intake port formed therein, wherein the first, second, third and fourth exhaust ports are axially aligned with one another when the lower and upper cylinder head members and housing are brought into engagement with one another, wherein the first, second, third and fourth intake ports are axially aligned with one another when the lower and upper cylinder head members and housing are brought into engagement with one another;

an intake rotor assembly including an intake rotor body, a first intake rotor shell portion, a second intake rotor shell portion, wherein the intake rotor assembly is operable to be rotatably received in the through bore of the housing;

wherein the intake rotor body includes an area defining a through bore extending therethrough, wherein the through bore of the intake rotor body includes a first open end and a spaced and opposed second open end, wherein the first and second intake rotor shell portions are operable to envelope a portion of the intake rotor body such that an air gap is formed between the first and second intake rotor shell portions, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions are operable to jointly rotate so that the first and second open ends of the through bore of the intake rotor body and the ports of the first and second intake rotor shell portions are in fluid communication with the first, second, third and fourth intake ports; and an exhaust rotor assembly including an exhaust rotor body, a first exhaust rotor shell portion, a second exhaust rotor shell portion, wherein the exhaust rotor assembly is operable to be rotatably received in the through bore of the housing;

wherein the exhaust rotor body includes an area defining a through bore extending therethrough, wherein the through bore of the exhaust rotor body includes a first open end and a spaced and opposed second open end, wherein the first and second exhaust rotor shell portions are operable to envelope a portion of the exhaust rotor body such that an air gap is formed between the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions are operable to jointly rotate so that the first and second open ends of the through bore of the exhaust rotor body and the ports of the first and second exhaust rotor shell portions are in fluid communication with the first, second, third and fourth exhaust ports.

In accordance with one aspect of this embodiment, at least one of the first and second intake rotor shell portions are operable to be urged outwardly towards or against an interior surface of the through bore of the housing in response to an increase or decrease in pressure of the cylinder in fluid communication with either of the first exhaust port or the first intake port.

In accordance with one aspect of this embodiment, at least one of the first and second intake rotor shell portions are operable to be urged outwardly towards or against an interior surface of the through bore of the housing in response to a gaseous flow from the cylinder in fluid communication with the first exhaust port or the first intake port, so as to create a seal therebetween.

In accordance with one aspect of this embodiment, at least one of the first and second exhaust rotor shell portions are operable to be urged outwardly towards or against an interior surface of the through bore of the housing in response to an increase or decrease in pressure of the cylinder in fluid communication with either of the first exhaust port or the first intake port.

In accordance with one aspect of this embodiment, at least one of the first and second exhaust rotor shell portions are operable to be urged outwardly towards or against an interior surface of the through bore of the housing in response to a gaseous flow from the cylinder in fluid communication with the first exhaust port or the first intake port, so as to create a seal therebetween.

In accordance with one aspect of this embodiment, wherein the intake rotor body and the exhaust rotor body include a shaft extending therefrom.

In accordance with one aspect of this embodiment, a shaft interconnection member is operable to interconnect the shaft of the exhaust rotor body and the shaft of the intake rotor body.

In accordance with one aspect of this embodiment, an interconnection member is operable to interconnect the intake rotor body and the exhaust rotor body such that intake rotor assembly simultaneously rotates with exhaust rotor assembly.

In accordance with a third embodiment of the present invention, a cylinder head assembly for a cylinder of a four stroke internal combustion engine is provided, comprising:

a cylinder head member, wherein the cylinder head member includes a first area defining a first intake port formed on a first upper surface thereof and a second intake port formed on a first lower surface thereof, wherein the cylinder head member includes a second area defining a first exhaust port formed on a second upper surface thereof and a second exhaust port formed on a second lower surface thereof;

wherein the cylinder head member includes an area defining a first through bore and a second through bore, wherein the first and second intake ports are axially aligned with one another and are in fluid communication with the first through bore, wherein the first and second exhaust ports are axially aligned with one another and are in fluid communication with the second through bore;

an intake rotor assembly including an intake rotor body, a first intake rotor shell portion, a second intake rotor shell portion, wherein the intake rotor assembly is operable to be rotatably received in the first through bore of the cylinder head member;

wherein the intake rotor body includes an area defining a through bore extending therethrough, wherein the through bore of the intake rotor body includes a first open end and a spaced and opposed second open end, wherein the first and second intake rotor shell portions are operable to envelope a portion of the intake rotor body such that an air gap is formed between the first and second intake rotor shell portions, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions are operable to jointly rotate so that the first and second open ends of the through bore of the intake rotor body and the ports of the first and second intake rotor shell portions are in fluid communication with the first and second intake ports; and an exhaust rotor assembly including an exhaust rotor body, a first exhaust rotor shell portion, a second exhaust rotor shell portion, wherein the exhaust rotor assembly is operable to be rotatably received in the second through bore of the cylinder head member;

wherein the exhaust rotor body includes an area defining a through bore extending therethrough, wherein the through bore of the exhaust rotor body includes a first open end and a spaced and opposed second open end, wherein the first and second exhaust rotor shell portions are operable to envelope a portion of the exhaust rotor body such that an air gap is formed between the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions are operable to jointly rotate so that the first and second open ends of the through bore of the exhaust rotor body and the ports of the first and second exhaust rotor shell portions are in fluid communication with the first and second exhaust ports.

In accordance with one aspect of this embodiment, at least one of the first and second intake rotor shell portions are operable to be urged outwardly towards or against an interior surface of the first through bore of the cylinder head member in response to an increase or decrease in pressure of a cylinder in fluid communication with either of the first exhaust port or the first intake port, or in response to a gaseous flow from the cylinder in fluid communication with the first exhaust port or the first intake port, so as to create a seal therebetween.

In accordance with one aspect of this embodiment, at least one of the first and second exhaust rotor shell portions are operable to be urged outwardly towards or against an interior surface of the second through bore of the cylinder head member in response to an increase or decrease in pressure of a cylinder in fluid communication with either of the first exhaust port or the first intake port, or in response to a gaseous flow from the cylinder in fluid communication with the first exhaust port or the first intake port, so as to create a seal therebetween.

In accordance with one aspect of this embodiment, the intake rotor body and the exhaust rotor body include a shaft extending therefrom, wherein a shaft interconnection member operable to interconnect the shaft of the exhaust rotor body and the shaft of the intake rotor body.

Further areas of applicability of the present invention will become apparent from the detailed description provided hereinafter. It should be understood that the detailed description and specific examples, while indicating the preferred embodiment of the present invention, are intended for purposes of illustration only and are not intended to limit the scope of the present invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

The following description of the preferred embodiment(s) is merely exemplary in nature and is in no way intended to limit the present invention, or uses.

It should be noted that the terms "inner," "outer," "upper," "lower," "central," "interior," "exterior," "first," "second," "third," "fourth" and/or the like, as used herein, are intended for relative reference purposes only and are not intended to be limiting.

Figure 1A:
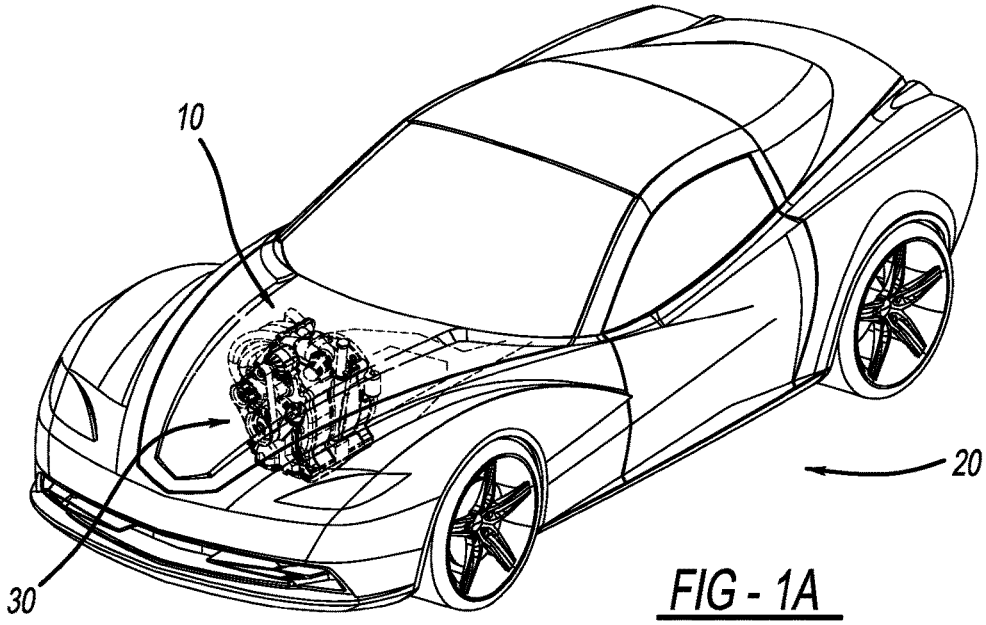
FIG. 1A is a perspective schematic view of an automobile having a rotary valve internal combustion engine system incorporated therein, in accordance with a first embodiment of the present invention.
Figure 2:
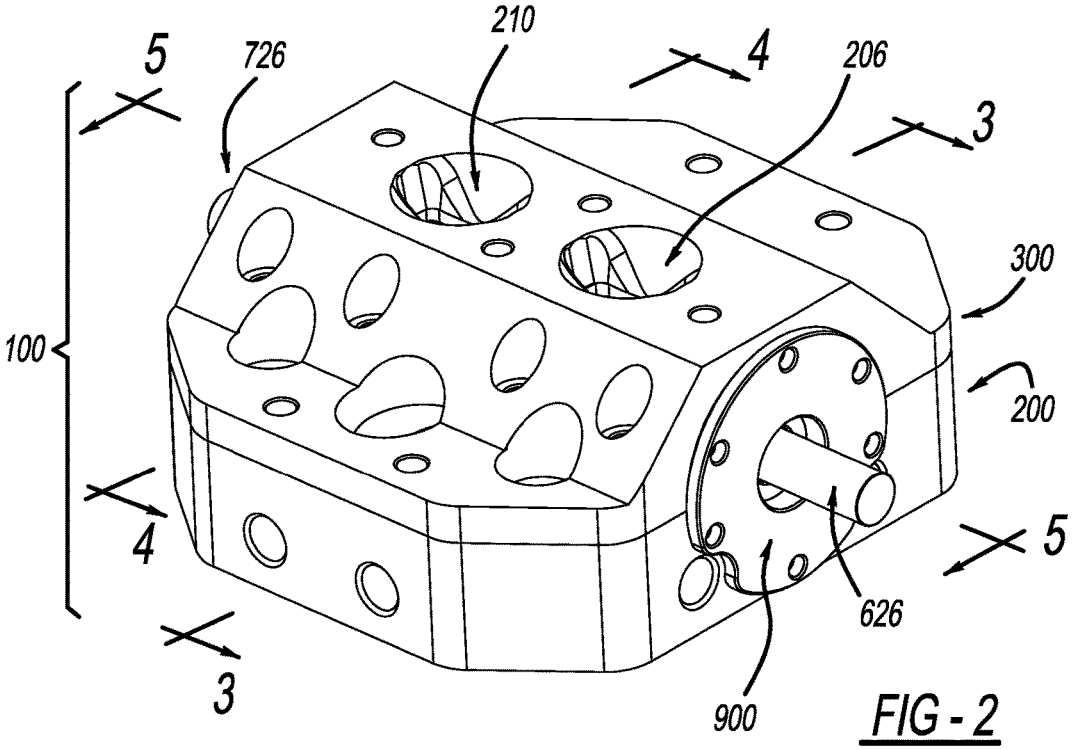
FIG. 2 is a perspective schematic view of a rotary valve assembly of a rotary valve internal combustion engine system, in accordance with a fourth embodiment of the present invention.
Figure 1B:
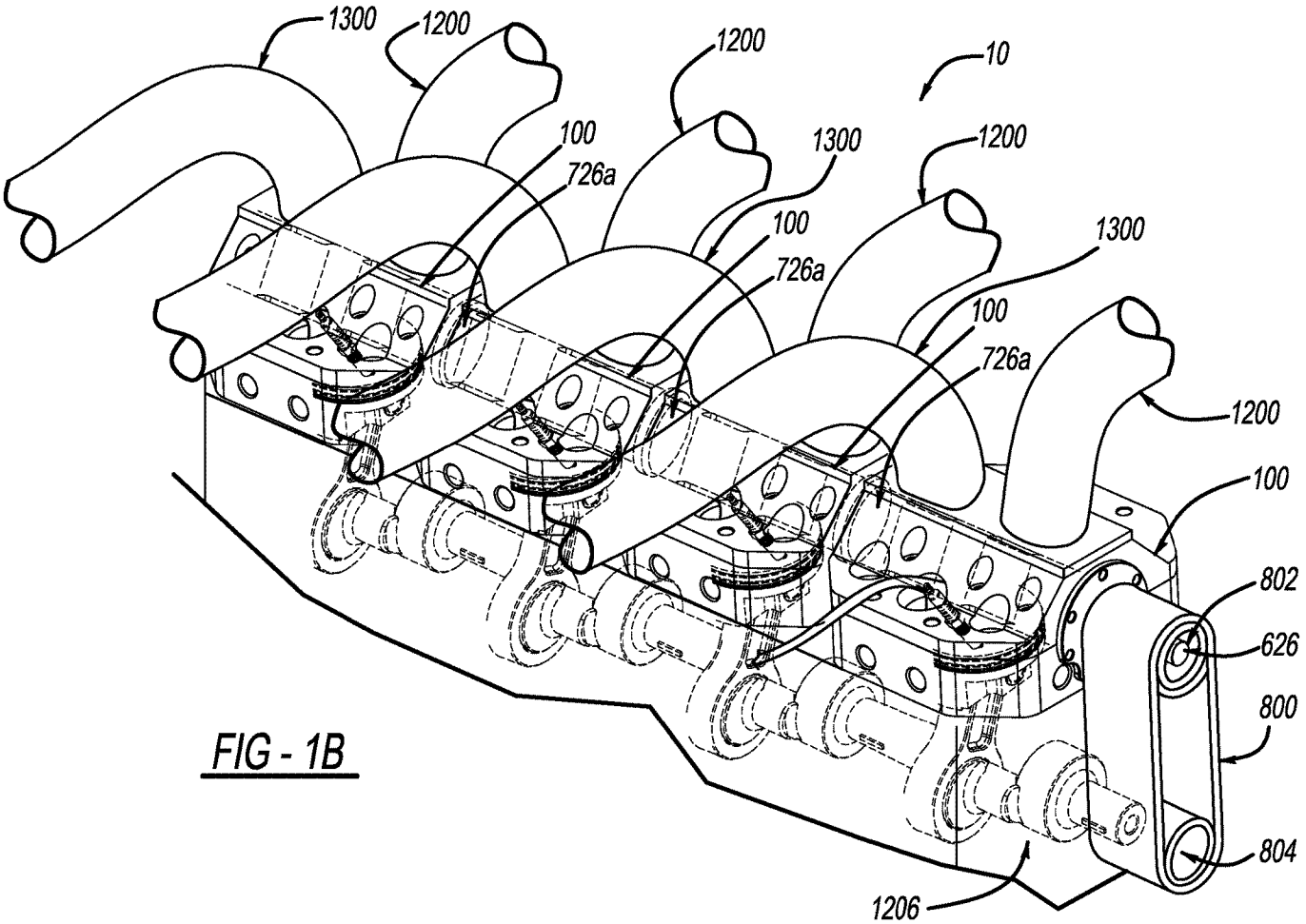
FIG. 1B is a partial perspective schematic view of the rotary valve internal combustion engine system depicted in FIG. 1A, in accordance with a second embodiment of the present invention.
Figure 1C:
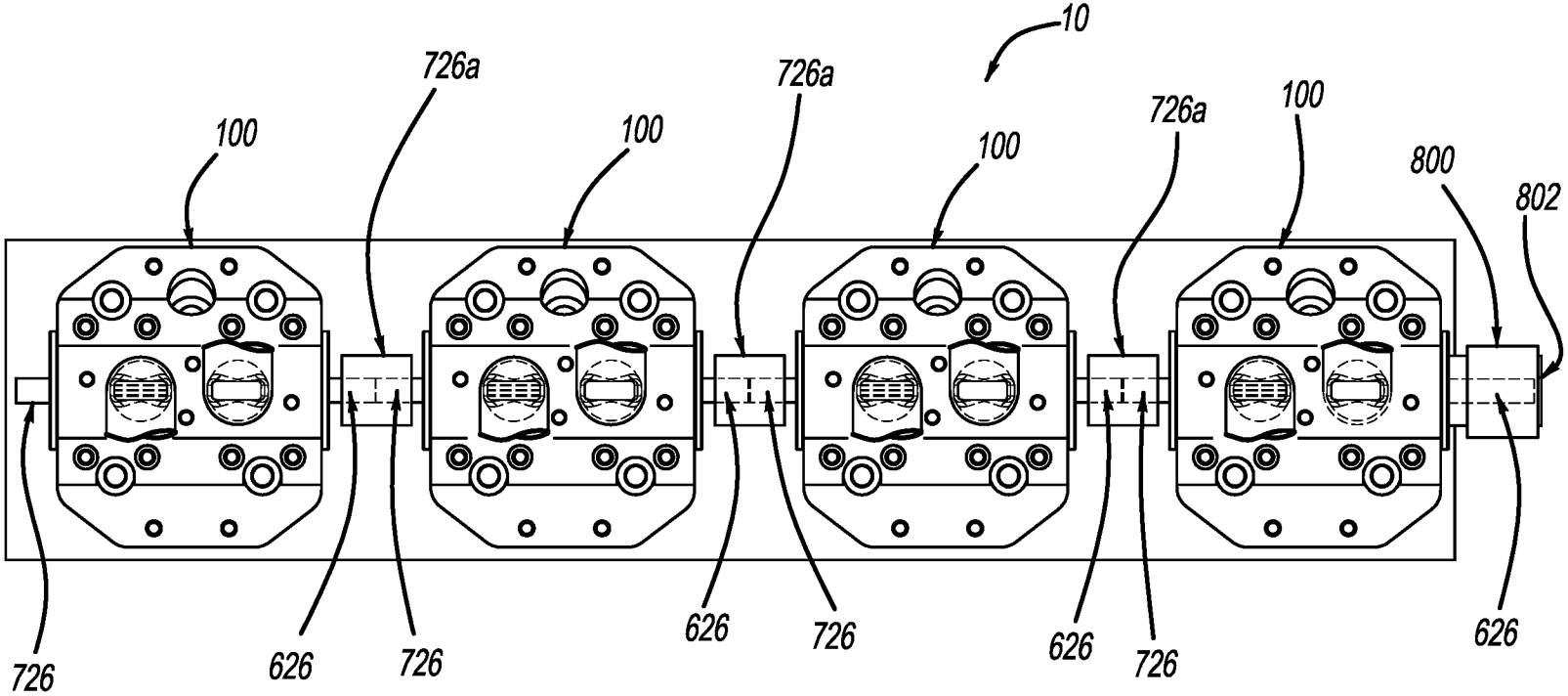
FIG. 1C is a partial plan schematic view of the rotary valve internal combustion engine system depicted in FIG. 1B, in accordance with a third embodiment of the present invention.
Figure 3:
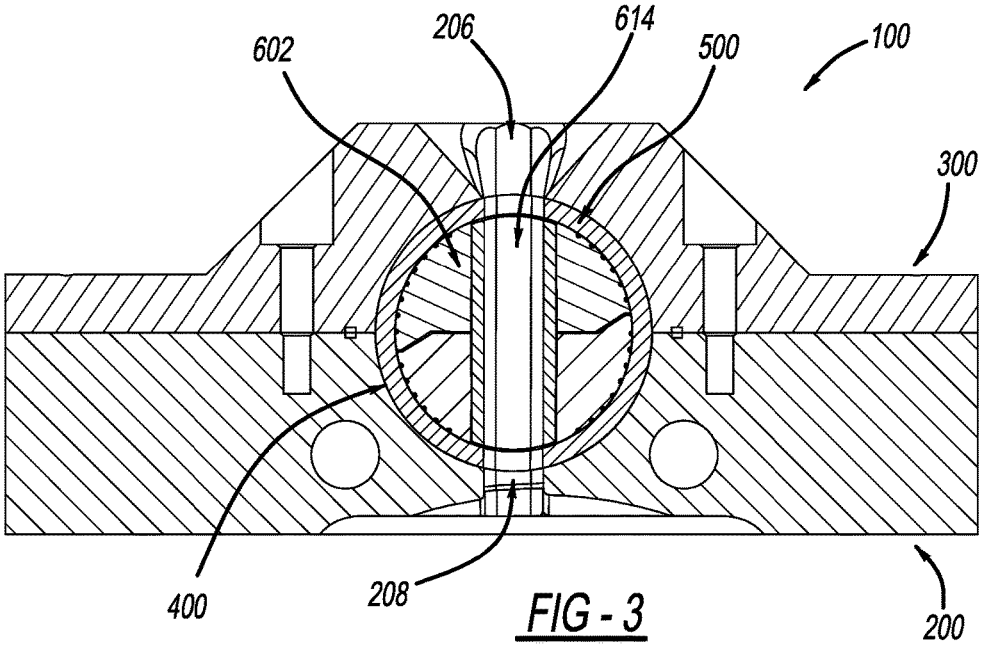
FIG. 3 is a sectional view along line 3-3 of FIG. 2, in accordance with a fifth embodiment of the present invention.
Figure 4:
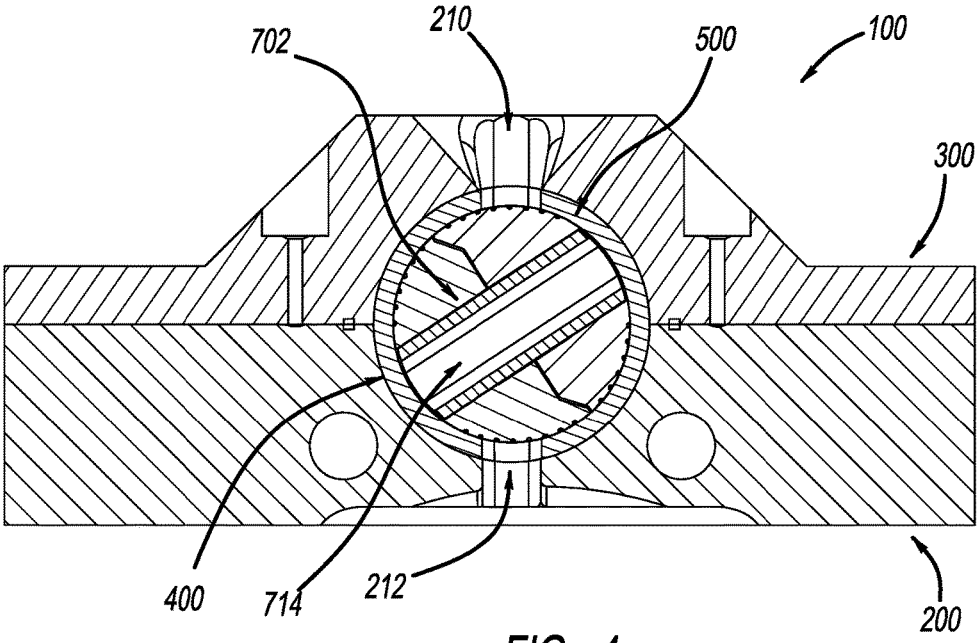
FIG. 4 is a sectional view along line 4-4 of FIG. 2, in accordance with a sixth embodiment of the present invention.
Figure 5:
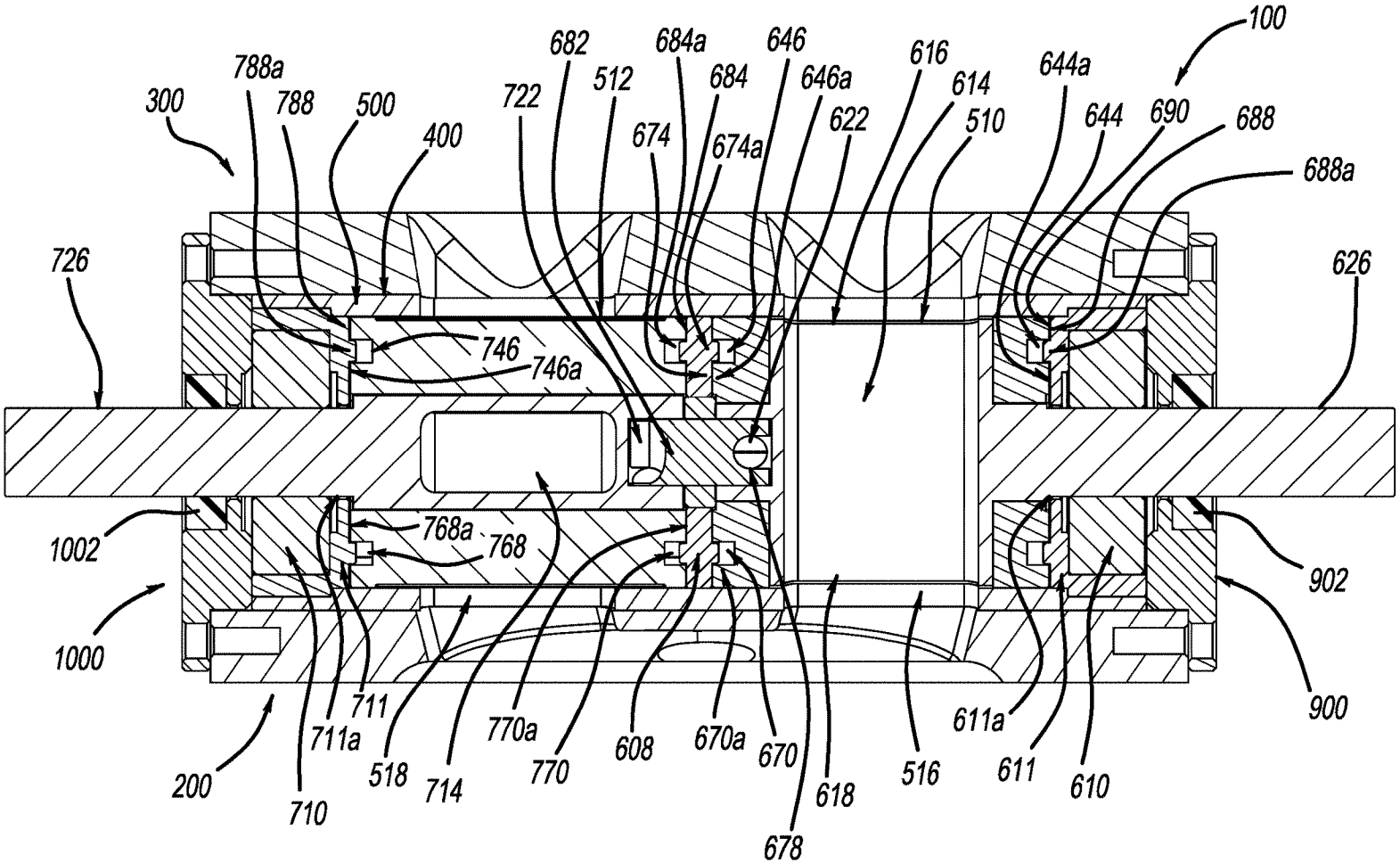
FIG. 5 is a sectional view along line 5-5 of FIG. 2, in accordance with a seventh embodiment of the present invention.

Referring to the Figures generally, and specifically to FIGS. 1A-1C, a new and improved rotary valve internal combustion engine system is generally shown at 10. Engine system 10 is shown as being operably associated with a passenger car 20; however, it should be appreciated that engine system 10 can be utilized in conjunction with any device that is compatible to be powered by an internal combustion engine such as, but not limited to, trucks, vans, motorcycles, scooters, all-terrain vehicles (ATV), lawn mowers and/or the like.

Furthermore, engine system 10 would be mounted and secured in place as would any conventional engine (e.g., via a plurality of engine mounts and/or the like), and accordingly, as conventional engine mounting technology is well-known in the art, the specific methodology of mounting engine system 10 into an engine compartment 30 will not be discussed in any specific detail herein.

It should also be appreciated, that once engine system 10 has been mounted and secured within engine compartment 30, any number of conventional automotive components may be brought into operable association with engine system 10, including but not limited to intake lines, exhaust lines, coolant lines, spark plugs, fuel injectors/carburetors, wiring harnesses, transmission connections and/or the like, and accordingly, as conventional engine installation and preparation technology is well-known in the art, the specific methodology of bringing engine system 10 into operable association with these conventional automotive components will not be discussed in any specific detail herein.

Referring to FIGS. 2-6B and 11A-11B, a new and improved cylinder head assembly 100 is provided for engine system 10.

Cylinder head assembly 100 may include a lower cylinder head member 200 and an upper cylinder head member 300, wherein lower cylinder head member 200 and upper cylinder head member 300 may be operable to be brought into engagement with one another and may be secured to one another through any number of suitable fastening members, such as but not limited to screws, bolts and/or the like. Lower cylinder head member 200 and upper cylinder head member 300 may each include an area defining a semi-circular surface, 202, 302, respectively, extending along a length (e.g., the entire length) of an interior surface 204, 304, respectively, of lower cylinder head member 200 and upper cylinder head member 300. When lower cylinder head member 200 and upper cylinder head member 300 are brought into engagement with one another semi-circular surfaces, 202, 302, respectively, they may define a circular through bore 400 extending along a length (e.g., the entire length) of lower cylinder head member 200 and upper cylinder head member 300. Alternatively, cylinder head assembly 100 may be formed (e.g., milled) from a single, monolithic piece of an appropriate material, rather than employing separate lower and upper cylinder head members 200, 300, respectively. By way of a non-limiting example, lower and upper cylinder head members 200, 300, respectively, may be comprised of cast iron, cast aluminum, billet aluminum, steel, titanium, magnesium, and/or the like.

A hollow housing 500 may be received within through bore 400. By way of a non-limiting example, housing 500 may be configured such that it is completely received within through bore 400 but does not extend the entire length of through bore 400. Housing 500 may be circular or tubular in configuration and have an outer diameter that is the same or substantially the same as a diameter of through bore 400, such that housing 500 is fairly tightly or firmly received with through bore 400. That is, there should preferably not be any appreciable gap between the outer diameter of housing 500 and the diameter of through bore 400 such that housing 500 is not able to rotate relative to bore 400. By way of a non-limiting example, housing 500 may be comprised of cast iron, steel, chrome moly, chrome plated steel, chrome plated cast iron, nickel/chrome plated aluminum, magnesium, and/or the like.

Housing 500 may define a circular through bore 502 extending along a length (e.g., the entire length) of housing 500. Housing 500 may include an outer surface 504 and an inner surface 506. Formed on an upper portion 508 of housing 500 may be areas defining an upper intake port 510 and an upper exhaust port 512, axially aligned with each other but spaced apart from one another, the intended purpose and function of which will be explained herein. Formed on a lower portion 513 of housing 500 may be areas defining a lower intake port 516 and a lower exhaust port 518, axially aligned with each other but spaced apart from one another, the intended purpose and function of which will be explained herein. Formed on a central portion 520 of housing 500 may be areas defining apertures 522, 524, 526, respectively, axially aligned with each other but spaced apart from one another, the intended purpose and function of which will be explained herein. Apertures 522, 524, 526, respectively, may be formed on either side of central portion 520 of housing 500. Formed on inner surface 506 of housing 500 may be an annular groove 528 formed near a first open end 530 of housing 500 and another annular groove 532 may be formed near a second open end 534 of housing 500, the intended purpose and function of which will be explained herein. By way of a non-limiting example, annular groove 528 may have a diameter that is slightly greatly than the diameter of inner surface 506 of housing 500, and annular groove 532 may have a diameter that is slightly greatly than the diameter of inner surface 506 of housing 500.

By way of a non-limiting example, the need for housing 500 may be eliminated by merely milling suitable port profiles corresponding to upper intake port 510, upper exhaust port 512, lower intake port 516, and lower exhaust port 518 on interior surface 204, 304, respectively, of lower cylinder head member 200 and upper cylinder head member 300, respectively. By way of a non-limiting example, a cylinder head member (e.g., lower cylinder head member 200 and upper cylinder head member 300, respectively) may be formed of a one piece cast or machined billet aluminum cylinder head. With the respective rotor assemblies on a common shaft or two shafts (e.g., a dual plane design), it may be necessary to chrome plate or NIKASIL™ plate (e.g., an electrodeposited lipophilic nickel matrix silicon carbide coating for engine components, mainly piston engine cylinder liners) an inner diameter of one or more through bores formed in the cylinder head member, so that the respective rotor shells (which may be formed of a ceramic material) do not damage or destroy these surfaces. If a cast iron cylinder head member is employed, one may not have to chrome plate the one or more through bore surfaces formed in the cylinder head member.

An intake rotor assembly 600 may be provided, the intended purpose and function of which will be explained herein. Intake rotor assembly 600 may include an intake rotor body 602, a first intake rotor shell portion 604, a second intake rotor shell portion 606, and an intake rotor body support bushing 610 (e.g., received in a bearing support housing 611), the intended purpose and function of which will be explained herein. By way of a non-limiting example, intake rotor body 602 may be comprised of steel, cast iron, chrome moly, titanium, various steel alloys, and/or the like. By way of a non-limiting example, intake rotor shell portions 604, 606 may be comprised of ceramic, hard anodized aluminum, plated magnesium, nickel bronze alloys. By way of a non-limiting example, intake rotor body support busing 610 may be comprised of ceramic, bronze, brass, graphite impregnated brass, composite materials, and/or the like. By way of a non-limiting example, bearing support housing 611 may be comprised of cast iron, steel, chrome moly, plated steel alloys, and/or the like.

Intake rotor body 602 may include a runner portion 612. Runner portion 612 may include a through bore 614 formed therein, including a first open end 616 and a spaced and opposed second open end 618, the intended purpose and function of which will be explained herein. On a first end portion 620 of intake rotor body 602 there may be provided a connection portion 622, the intended purpose and function of which will be explained herein. On a second end portion 624 of intake rotor body 602 there may be provided a shaft member 626, the intended purpose and function of which will be explained herein.

First intake rotor shell portion 604 may include an area defining a port 628 formed on a portion thereof, the intended purpose and function of which will be explained herein. First intake rotor shell portion 604 may include a chamfered surface 630 formed on a first edge portion 632 thereof and a reverse chamfered surface 634 formed on a spaced and opposed second edge portion 636 thereof, the intended purpose and function of which will be explained herein. First intake rotor shell portion 604 may include a plurality of "buffer" grooves 638 formed on an exterior surface 640 thereof, the intended purpose and function of which will be explained herein. Although seven grooves 638 are shown, it should be appreciated that either less than or more than this number of grooves 638 may be employed. First intake rotor shell portion 604 may include an opening 641 formed on a side surface 642 thereof, the intended purpose and function of which will be explained herein. Although the configuration of opening 641 is shown as being substantially square or rectangular, it should be appreciated that other configurations may be employed. First intake rotor shell portion 604 may include one or more grooves 644 and corresponding protuberances 644*a* formed on side surface 642, the intended purpose and function of which will be explained herein. First intake rotor shell portion 604 may include one or more grooves 646 and corresponding protuberances 646*a* formed on a spaced and opposed second side surface 648, the intended purpose and function of which will be explained herein.

Second intake rotor shell portion 606 may include an area defining a port 650 formed on a portion thereof, the intended purpose and function of which will be explained herein. Second intake rotor shell portion 606 may include a chamfered surface 652 formed on a first edge portion 654 thereof and a reverse chamfered surface 656 formed on a spaced and opposed second edge portion 658 thereof, the intended purpose and function of which will be explained herein. Second intake rotor shell portion 606 may include a plurality of grooves 660 formed on an exterior surface 662 thereof, the intended purpose and function of which will be explained herein. Although seven grooves 660 are shown, it should be appreciated that either less than or more than this number of grooves 660 may be employed. Second intake rotor shell portion 606 may include an opening 664 formed on a side surface 666 thereof, the intended purpose and function of which will be explained herein. Although the configuration of opening 664 is shown as being substantially square or rectangular, it should be appreciated that other configurations may be employed. Second intake rotor shell portion 606 may include one or more grooves 668 and corresponding protuberances 668*a* formed on side surface 666, the intended purpose and function of which will be explained herein. Second intake rotor shell portion 606 may include one or more grooves 670 and corresponding protuberances 670*a* formed on a spaced and opposed second side surface 672, the intended purpose and function of which will be explained herein.

By way of a non-limiting example, it is intended to bring first and second rotor shell portions 604, 606, respectively, into close proximity or engagement with one another such that port 628 is brought into alignment with first open end 616 of rotor body 602, and port 650 is brought into alignment with first open end 618 of rotor body 602. It should be noted that first and second rotor shell portions 604, 606, respectively, are not physically secured to one another or any other structure for that matter, and, as such, are intended to be "free floating," the intended purpose and function of which will be explained herein. It should be noted that the respective grooves and protuberances of the side surfaces of the respective rotor shell portions (when assembled together) are intended to correspond to one another such that an offset does not exist.

A center plate 608 is shown as being circular in configuration so as to be mateable with second side surfaces 648, 672, respectively, when first and second rotor shell portion 604, 606, respectively, are brought into close proximity or engagement with one another. Center plate 608 may include one or more grooves 674 and corresponding protuberances 674*a* on a first surface 676 that are intended to correspondingly mate with grooves 638, 670, respectively, of first and second intake rotor shell portions 604, 606, respectively. First surface 676 may include a connection portion 678 that is intended to mate with and/or interconnect with connection portion 622 so as to interconnect center plate 608 with intake rotor body 602. On a spaced and opposed second surface 680 of center plate 608 there may be provided a second connection portion 682, the intended purpose and function of which will be explained herein. Center plate 608 may include one or more grooves 684 and corresponding protuberances 684*a* on second surface 680, the intended purpose and function of which will be explained herein. By way of a non-limiting example, center plate 608 may be comprised of cast iron, steel, steel alloys, chrome moly, chrome plated steel alloys, and/or the like.

Intake rotor body bearing support housing 611 is shown as being circular in configuration so as to be mateable with side surfaces 642, 666, respectively, when first and second rotor shell portions 604, 606, respectively, are brought into close proximity or engagement with one another. Intake rotor body bearing support housing 611 may include one or more grooves 688 and corresponding protuberances 688*a* on a first surface 690 that are intended to correspondingly mate with grooves 644, 668, respectively, and corresponding protuberances 644*a* and 668*a*, respectively, of first and second intake rotor shell portions 604, 606, respectively. Intake rotor body support bushing 610 may include a centrally located through bore 692 (aligned with an aperture 611*a* formed on bearing support housing 611) to receive shaft member 626 therethrough. Intake rotor body bearing support housing 611 is intended to be received within annular groove 528 formed near first open end 530 of housing 500. Intake rotor body support bushing 610 would be seated within bearing support housing 611. Intake rotor body support bushing 610 is preferably formed of a ceramic material.

An exhaust rotor assembly 700 may be provided, the intended purpose and function of which will be explained herein. Exhaust rotor assembly 700 may include an exhaust rotor body 702, a first exhaust rotor shell portion 704, a second exhaust rotor shell portion 706, and an exhaust rotor body support bushing 710 (e.g., received in a bearing support housing 711), the intended purpose and function of which will be explained herein. By way of a non-limiting example, exhaust rotor body 702 may be comprised of cast iron, steel, chrome moly, chrome plated steel alloys, and/or the like. By way of a non-limiting example, exhaust rotor shell portions 704, 706 may be comprised of ceramic, hard anodized aluminum alloys, plated magnesium, nickel bronze alloys, and/or the like. By way of a non-limiting example, exhaust rotor body support busing 710 may be comprised of ceramic, bronze, brass, graphite impregnated brass, composite materials, and/or the like. By way of a non-limiting example, bearing support housing 711 may be comprised of cast iron, steel, chrome moly, plated steel alloys, and/or the like.

Exhaust rotor body 702 may include a runner portion 712. Runner portion 712 may include a through bore 714 formed therein, including a first open end 716 and a spaced and opposed second open end 718, the intended purpose and function of which will be explained herein. On a first end portion 720 of exhaust rotor body 702 there may be provided a connection portion 722, the intended purpose and function of which will be explained herein. On a second end portion 724 of exhaust rotor body 702 there may be provided a shaft member 726, the intended purpose and function of which will be explained herein.

First exhaust rotor shell portion 704 may include an area defining a port 728 formed on a portion thereof, the intended purpose and function of which will be explained herein. First exhaust rotor shell portion 704 may include a chamfered surface 730 formed on a first edge portion 732 thereof and a reverse chamfered surface 734 formed on a spaced and opposed second edge portion 736 thereof, the intended purpose and function of which will be explained herein. First exhaust rotor shell portion 704 may include a plurality of "buffer" grooves 738 formed on an exterior surface 740 thereof, the intended purpose and function of which will be explained herein. Although seven grooves 738 are shown, it should be appreciated that either less than or more than this number of grooves 738 may be employed. First exhaust rotor shell portion 704 may include an opening 741 formed on a side surface 742 thereof, the intended purpose and function of which will be explained herein. Although the configuration of opening 741 is shown as being substantially square or rectangular, it should be appreciated that other configurations may be employed. First exhaust rotor shell portion 704 may include one or more grooves 744 and corresponding protuberances 744*a* formed on side surface 742, the intended purpose and function of which will be explained herein. First exhaust rotor shell portion 704 may include one or more grooves 746 and corresponding protuberances 746*a* formed on a spaced and opposed second side surface 748, the intended purpose and function of which will be explained herein.

Second exhaust rotor shell portion 706 may include an area defining a port 750 formed on a portion thereof, the intended purpose and function of which will be explained herein. Second exhaust shell portion 706 may include a chamfered surface 752 formed on a first edge portion 754 thereof and a reverse chamfered surface 756 formed on a spaced and opposed second edge portion 758 thereof, the intended purpose and function of which will be explained herein. Second exhaust rotor shell portion 706 may include a plurality of grooves 760 formed on an exterior surface 762 thereof, the intended purpose and function of which will be explained herein. Although seven grooves 760 are shown, it should be appreciated that either less than or more than this number of grooves 760 may be employed. Second exhaust rotor shell portion 706 may include an opening 764 formed on a side surface 766 thereof, the intended purpose and function of which will be explained herein. Although the configuration of opening 764 is shown as being substantially square or rectangular, it should be appreciated that other configurations may be employed. Second exhaust rotor shell portion 706 may include one or more grooves 768 and corresponding protuberances 768*a* formed on side surface 766, the intended purpose and function of which will be explained herein. Second exhaust rotor shell portion 706 may include one or more grooves 770 and corresponding protuberances 770*a* formed on a spaced and opposed second side surface 772, the intended purpose and function of which will be explained herein. It should be noted that the respective grooves and protuberances of the side surfaces of the respective rotor shell portions (when assembled together) are intended to correspond to one another such that an offset does not exist.

By way of a non-limiting example, it is intended to bring first and second exhaust rotor shell portions 704, 706, respectively, into close proximity or engagement with one another such that port 728 is brought into alignment with first open end 716 of rotor body 702, and port 750 is brought into alignment with first open end 718 of exhaust rotor body 702. It should be noted that first and second exhaust rotor shell portions 704, 706, respectively, are not physically secured to one another or any other structure for that matter, and, as such, are intended to be "free floating," the intended purpose and function of which will be explained herein.

Exhaust rotor body bearing support housing 711 is shown as being circular in configuration so as to be mateable with side surfaces 742, 766, respectively, when first and second exhaust rotor shell portions 704, 706, respectively, are brought into close proximity or engagement with one another. Exhaust rotor body bearing support housing 711 may include one or more grooves 788 and corresponding protuberances 788*a* on a first surface 790 that are intended to correspondingly mate with grooves 746, 768, respectively, and corresponding protuberances 746*a*, 768*a*, respectively, of first and second exhaust rotor shell portions 704, 706, respectively. Exhaust rotor body support bushing 710 may include a centrally located through bore 792 (aligned with an aperture 711*a* formed on bearing support housing 711) to receive shaft member 726 therethrough. Exhaust rotor body bearing support housing 711 is intended to be received within annular groove 532 formed near second open end 534 of housing 500. Exhaust rotor body support bushing 710 would be seated within bearing support housing 711. Exhaust rotor body support bushing 710 is preferably formed of a ceramic material.

By way of a non-limiting example, the port opening size, length and width, may affect the cycle timing of a four stroke engine. By altering this port opening, and rotating runner inside dimension, it may allow for more airflow through the engine, but also may change the valve timing for any particular engine combination. For example, stock engines usually require relatively small port runner opening sizes, whereas racing engines and high revving engines will require larger port window openings and rotating runner inside dimensions. This again allows more of an air/fuel mixture to enter into the combustion chamber, but also changes the valve timing for this particular type of high revving race engine. A conventional poppet valve engine in a racing application would have typically higher valve lift and longer valve opening duration than a stock type nonracing engine. The same is true with a rotary valve engine, that is, the port timing and runner inside dimensions allow for this type of tuning per engine application.

Once intake rotor assembly 600 and exhaust rotor assembly 700 have been assembled as described above (except for the installation of intake rotor body bearing support housing 611 and/or exhaust rotor body (e.g., received in a bearing support housing 711), they may be interconnected together in a pre-determined orientation to one another. That is, the desired orientation angle of intake rotor body 602 will be a function of the desired orientation angle of exhaust rotor body 702, and vice versa, so that the intake pathway of the cylinder is either open or closed, as the case may be, and the exhaust pathway of the cylinder is either open or closed, as the case may be, at the appropriate time and in the proper sequence.

In order to interconnect intake rotor assembly 600 to exhaust rotor assembly 700 in a pre-determined orientation to one another, connection portion 678 of center plate 608 mates with and/or interconnects with connection portion 622 of intake rotor body 602 so as to interconnect center plate 608 with intake rotor body 602, and second connection portion 682 mates with and/or interconnects with connection portion 722 of exhaust rotor body 702. Once, intake rotor assembly 600 and exhaust rotor assembly 700 are interconnected together as described above, relative rotation of the respective assemblies is not possible, i.e., they are positionally fixed relative to one another. That is, the desired orientation angle of intake rotor body 602 will be a function of the desired orientation angle of exhaust rotor body 702, and vice versa, so that the intake pathway of the cylinder is either open or closed, as the case may be, and the exhaust pathway of the cylinder is either open or closed, as the case may be, at the appropriate time and in the proper time sequence.

Once the fixed interconnection of intake rotor assembly 600 and exhaust rotor assembly 700 has been accomplished, the respectively assemblies can be inserted into housing 500 via one of open ends 530, 534, respectively. The installation of intake rotor body support bushing 610 and/or exhaust rotor body support bushing 710 can then be accomplished. At this stage, complete sealing of cylinder head assembly 100 can now be accomplished.

To secure housing 500 in place such that it is not operable to rotate (e.g., relative to bore 400), a suitable fastener (e.g., screw, bolt and/or the like) may be inserted through aperture 524 to interconnect lower cylinder head member 200 (or upper cylinder head member 300) with housing 500.

To secure intake rotor body bearing support housings 611 in place such that it is not operable to rotate, a suitable fastener (e.g., screw, bolt and/or the like) may be inserted through aperture 526 and aperture 610*a* (formed on intake rotor body bearing support housings 611) to interconnect intake rotor body bearing support housings 611 with housing 500.

To secure exhaust rotor body support bushing 710 in place such that it is not operable to rotate, a suitable fastener (e.g., screw, bolt and/or the like) may be inserted through aperture 522 and aperture 710*a* (formed on the exhaust rotor body bearing support housings 711) to interconnect exhaust rotor body bearing support housings 711 with housing 500.

An end plate 900 may be placed over the exposed portion of shaft member 626 and secured in place to lower cylinder head member 200 and upper cylinder head member 300 via any number of suitable fasteners such as, but not limited to screws, bolts and/or the like. By way of a non-limiting example, end plate 900 may be comprised of cast iron, steel, steel alloys, aluminum, aluminum alloys, titanium, magnesium, chrome moly, and/or the like. A seal member 902 (e.g., a rubber lip seal) may also be employed to further seal off the interior of cylinder head assembly 100. In this manner, infiltration of any harmful materials may be prevented from infiltrating into the interior of cylinder head assembly 100.

An end plate 1000 may be placed over the exposed portion of shaft member 726 and secured in place to lower cylinder head member 200 and upper cylinder head member 300 via any number of suitable fasteners such as, but not limited to screws, bolts and/or the like. By way of a non-limiting example, end plate 1000 may be comprised of cast iron, steel, steel alloys, aluminum, aluminum alloys, titanium, magnesium, chrome moly, and/or the like. A seal member 1002 (e.g., a rubber lip seal) may also be employed to further seal off the interior of cylinder head assembly 100. In this manner, infiltration of any harmful materials may be prevented from infiltrating into the interior of cylinder head assembly 100.

When both of end plates 900, 1000, respectively, are fastened to lower cylinder head member 200 and upper cylinder head member 300, respectively, via any number of suitable fasteners such as, but not limited to screws, bolts and/or the like, cylinder head assembly 100 is then fully sealed.

It should be appreciated that the interconnected intake rotor assembly 600 and exhaust rotor assembly 700 (except for intake rotor body support bushing 610 and exhaust rotor body support bushing 710) are operable to rotate in either a counterclockwise or clockwise direction (e.g., as shown in several of the Figures) within housing 500, such that first open end 616 and second open end 618 of through bore 614 of intake rotor body 602 may be brought into fluid communication with the intake pathway of the engine system and first open end 716 and second open end 718 of through bore 714 of exhaust rotor body 702 may be brought into fluid communication with the exhaust pathway of the engine system, as will be explained further herein. By way of a non-limiting example, this rotating shaft (i.e., the interconnected intake rotor assembly 600 and exhaust rotor assembly 700) encompasses both the intake and the exhaust ports that are machined or cast into these shafts at the correct angles to allow for the correct timing of a four stroke internal combustion engine.

Referring specifically to FIGS. 1B-1C, it should be understood that a plurality of individual cylinder head assemblies 100 may be interconnected together in a multiple cylinder arrangement. Although FIGS. 1B-1C depicts an "I-4" arrangement of four individual cylinder head assemblies 100, it should be appreciated that any number of individual cylinder head assemblies 100 may be interconnected together in an "I" configuration to provide the desired engine power performance, for example, a six cylinder ("I-6"), an eight cylinder ("I-8"), and so forth. Additionally, the cylinder head assemblies 100 may also be configured in a "V" configuration, in that there are two separate banks of individual cylinder head assemblies 100, wherein individual cylinder head assemblies 100 of the separate banks may be interconnected together. It should be appreciated that any number of individual cylinder head assemblies 100 may be interconnected together in a "V" configuration (along each bank) to provide the desired engine power performance, for example, a four cylinder ("V-4"), six cylinder ("V-6"), an eight cylinder ("V-8"), and so forth.

In order to interconnect individual cylinder head assemblies 100 together, it is necessary to couple shaft member 726 of exhaust rotor assembly 700 with shaft member 626 of intake rotor assembly 600. By way of a non-limiting example, a coupler 726*a* may be employed to rigidly and securely couple a terminal portion of shaft member 626 of intake rotor assembly 600 with a terminal portion of shaft member 726 of exhaust rotor assembly 700, such when shaft member 726 of exhaust rotor assembly 700 is rotating, coupled shaft member 626 of intake rotor assembly 600 simultaneously rotates in the same direction (e.g., clockwise or counterclockwise) and at the same speed (i.e., RPM), and vice versa. This type of arrangement would be repeated for each successive individual cylinder head assembly 100 that is to be added to the grouping of cylinder head assemblies. By way of a non-limiting example (assuming an "I" configuration is desired), for a two cylinder arrangement, one coupler 726*a* would be required, for a three cylinder arrangement, two couplers 726*a* would be required, for a four cylinder arrangement, three couplers 726*a* would be required, for a five cylinder arrangement, four couplers 726*a* would be required, for a six cylinder arrangement, five couplers 726*a* would be required, for a seven cylinder arrangement, six couplers 726*a* would be required, for an eight cylinder arrangement, seven couplers 726*a* would be required, and so forth. By way of a non-limiting example, coupler 726*a* may be comprised of steel, steel alloys, chrome moly, titanium, and/or the like.

Referring to FIGS. 7-10, a description will be provided of the function of cylinder head assembly 100 during a four stroke operation of engine system 10. In these views, cylinder head assembly 100 is shown as being mounted, via any number of suitable fasteners such as, but not limited to screws, bolts and/or the like, to a combined cylinder block/crankcase 1100, comprising a cylinder block portion 1102 and a crankcase portion 1104. Additionally, a spark plug 1106 is provided. As is generally known in the art, spark plug 1106 is a device for delivering an electric current (an ignition system) to a combustion chamber 1108 to ignite a compressed fuel/air mixture by an electric spark.

Figure 7:
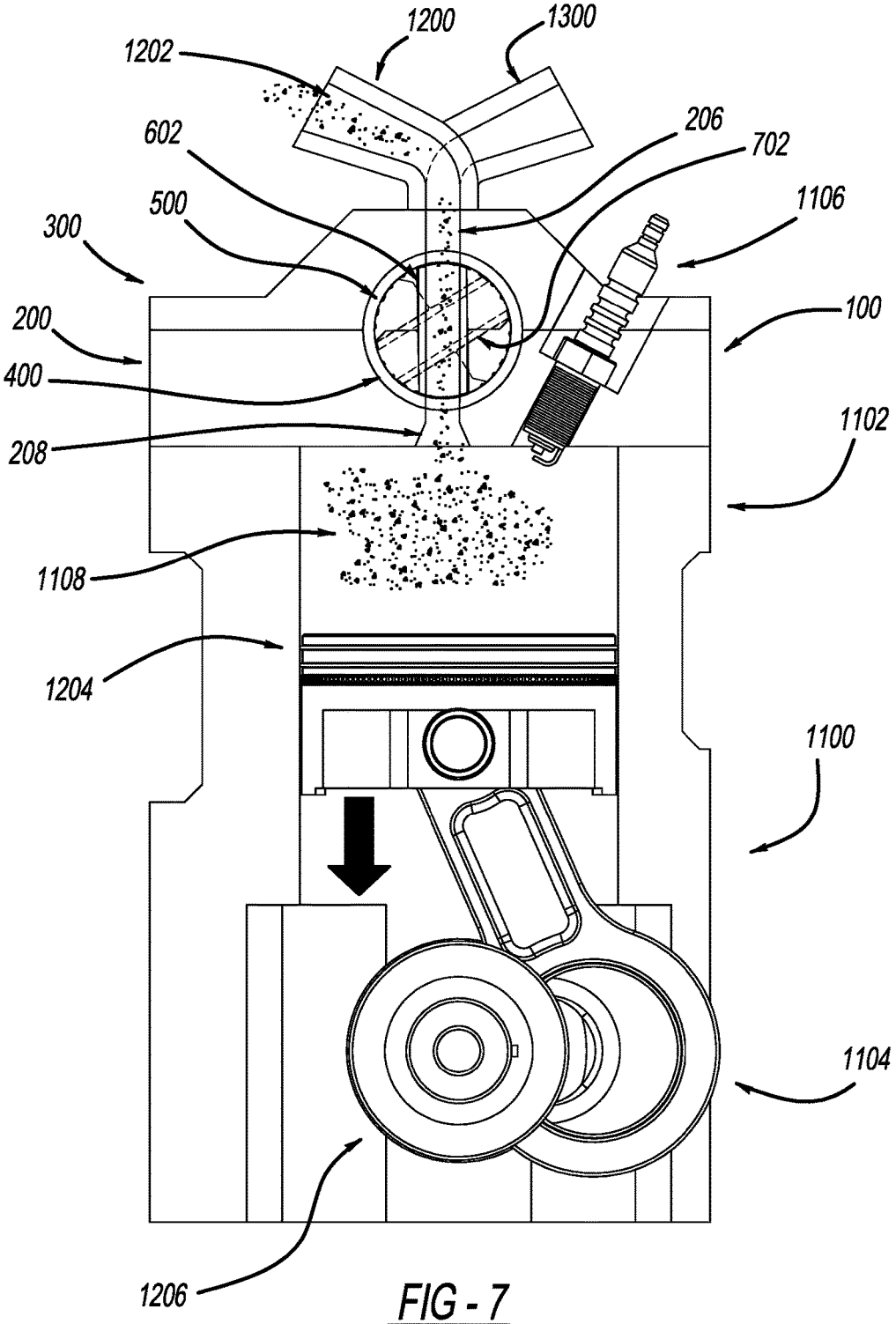
FIG. 7 is a partial sectional schematic view of a rotary valve internal combustion engine system during an intake stroke, in accordance with a tenth embodiment of the present invention.

Referring specifically to FIG. 7, an intake or induction stroke is shown, wherein intake rotor body 602 is shown in the open position, wherein first open end 616 and second open end 618 of through bore 614 of intake rotor body 602 may be brought into fluid communication with the intake pathway of the engine system, specifically bore 206 formed through a portion of upper cylinder head member 300 and bore 208 formed through a portion of lower cylinder head member 200. In this manner, a continuous fluid pathway may be established from an intake manifold 1200, through bore 206, through port 628, through first open end 616, through bore 614, through second open end 618, through port 650, through bore 208, and into combustion chamber 1108. At the same time, it should be noted that exhaust rotor body 702 is shown in the closed position. In practice, an air/fuel mixture 1202 would be charged through intake manifold 1200, through bore 206, through port 628, through first open end 616, through bore 614, through second open end 618, through port 650, through bore 208, and into combustion chamber 1108. This stroke of a piston assembly 1204 would typically begin at top dead center (TDC) and end at bottom dead center (BDC). In this stroke, intake rotor body 602 must be in the open position while piston assembly 1204 pulls air-fuel mixture 1202 into combustion chamber 1108 by producing vacuum pressure into combustion chamber 1108 through its downward motion, as indicated by the arrow. As exhaust rotor body 702 is in the closed position, air/fuel mixture 1202 is preventing from escaping from combustion chamber 1108.

Figure 8:
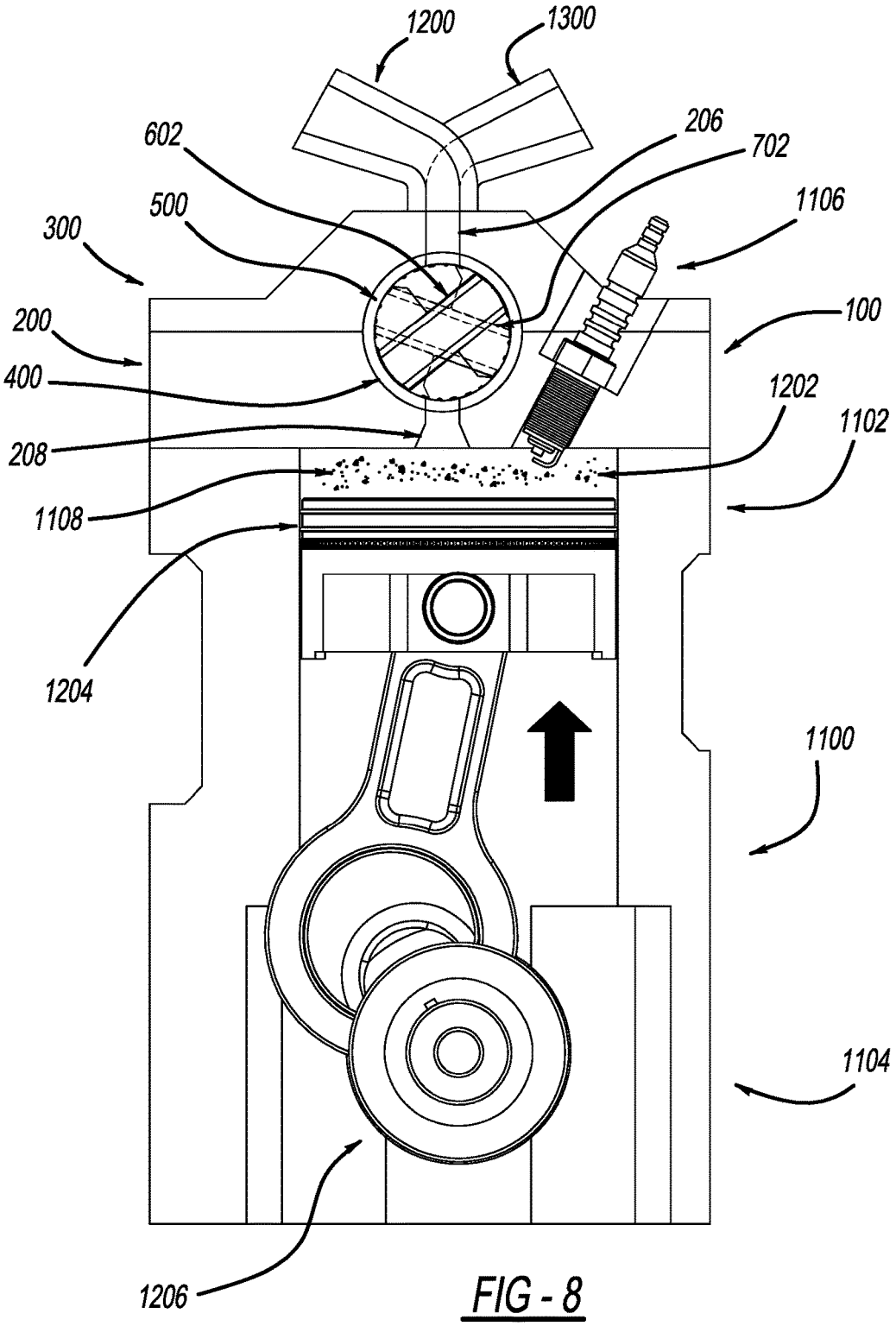
FIG. 8 is a partial sectional schematic view of a rotary valve internal combustion engine system during a compression stroke, in accordance with an eleventh embodiment of the present invention.

Referring specifically to FIG. 8, a compression stroke is shown, wherein intake rotor body 602 and exhaust rotor body 702 are both shown in the closed position. In practice, air/fuel mixture 1202 is rapidly and forcefully compressed by rising piston assembly 1204. This stroke typically begins at BDC, or just at the end of the suction stroke, and ends at TDC. In this stroke, piston assembly 1204 travels upwardly and compresses air-fuel mixture 1202 in preparation for ignition during the power stroke, as indicated by the arrow.

Figure 9:
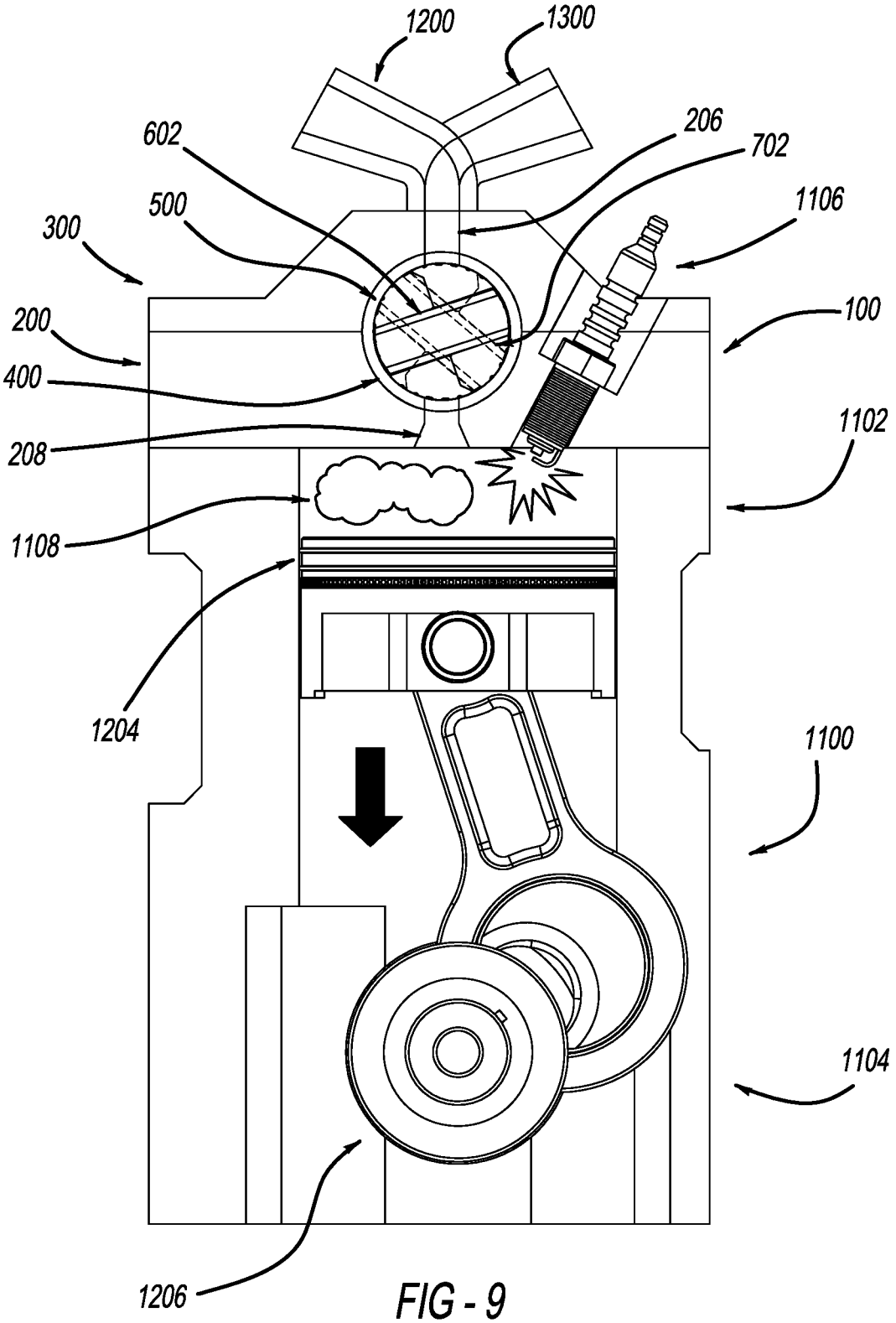
FIG. 9 is a partial sectional schematic view of a rotary valve internal combustion engine system during a power stroke, in accordance with a twelfth embodiment of the present invention.

Referring specifically to FIG. 9, a power (or combustion) stroke is shown, wherein intake rotor body 602 and exhaust rotor body 702 are still both shown in the closed position. In practice, this is the start of the second revolution of the four stroke cycle. At this point, a crankshaft 1206 has completed a full 360 degree revolution. While piston assembly 1204 is near TDC (i.e., the end of the compression stroke), compressed air-fuel mixture 1202 (e.g., as best shown in FIG. 8) is ignited by spark plug 1106 (e.g., in a gasoline or gasoline blend engine) or by heat generated by high compression (e.g., in diesel engines) producing a rapidly expanding gas, forcefully returning piston assembly 1204 to BDC, as indicated by the arrow. This stroke produces mechanical work from the engine to turn crankshaft 1206.

Figure 10:
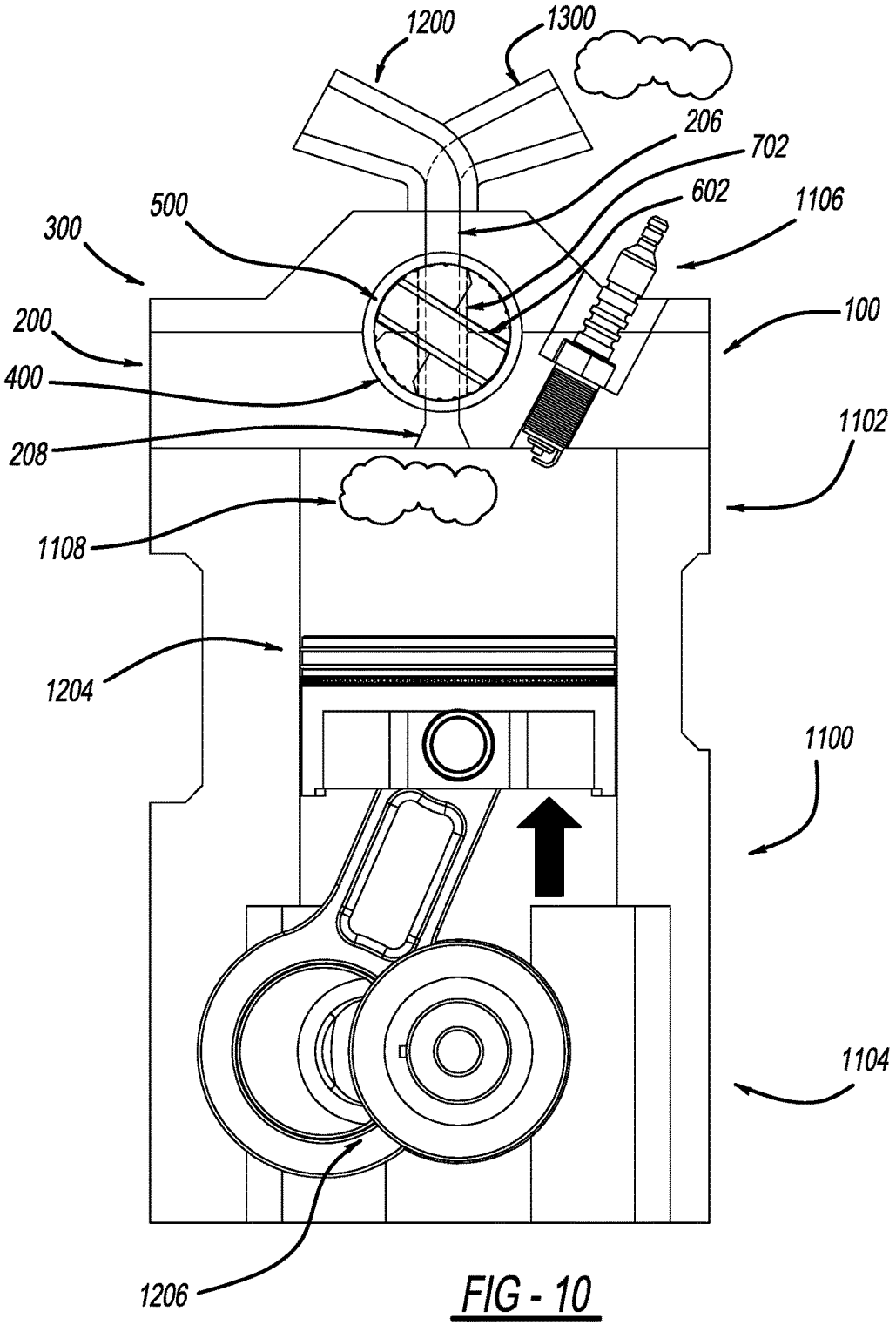
FIG. 10 is a partial sectional schematic view of a rotary valve internal combustion engine system during an exhaust stroke, in accordance with a thirteenth embodiment of the present invention.

Referring specifically to FIG. 10, an exhaust stroke is shown, wherein intake rotor body 602 remains closed; however, exhaust rotor body 702 is shown in the open position. Specifically, first open end 716 and second open end 718 of through bore 714 of exhaust rotor body 702 may be brought into fluid communication with the exhaust pathway of the engine system, specifically bore 210 formed through a portion of upper cylinder head member 300 and bore 212 formed through a portion of lower cylinder head member 200. In this manner, a continuous fluid pathway may be established from an exhaust manifold 1300, through bore 210, through port 728, through first open end 716, through bore 714, through second open end 718, through port 750, through bore 212, and into combustion chamber 1108. In practice, during the exhaust stroke, piston assembly 1204 once again returns from BDC to TDC while exhaust rotor body 702 is open, as indicated by the arrow. This action expels the spent air-fuel mixture 1202 through exhaust manifold 1300 (e.g., for further processing by the vehicle's exhaust system, e.g., by the vehicle's catalytic converter).

As previously noted, conventional rotary valve engine systems have the significant deficiency of not being able to provide an adequate, long lasting sealing system between the inlet/outlet valves and the cylinder, specifically, the combustion chamber of the cylinder. The present invention avoids this significant disadvantage by not using a conventional rotor seal.

Figure 11A:
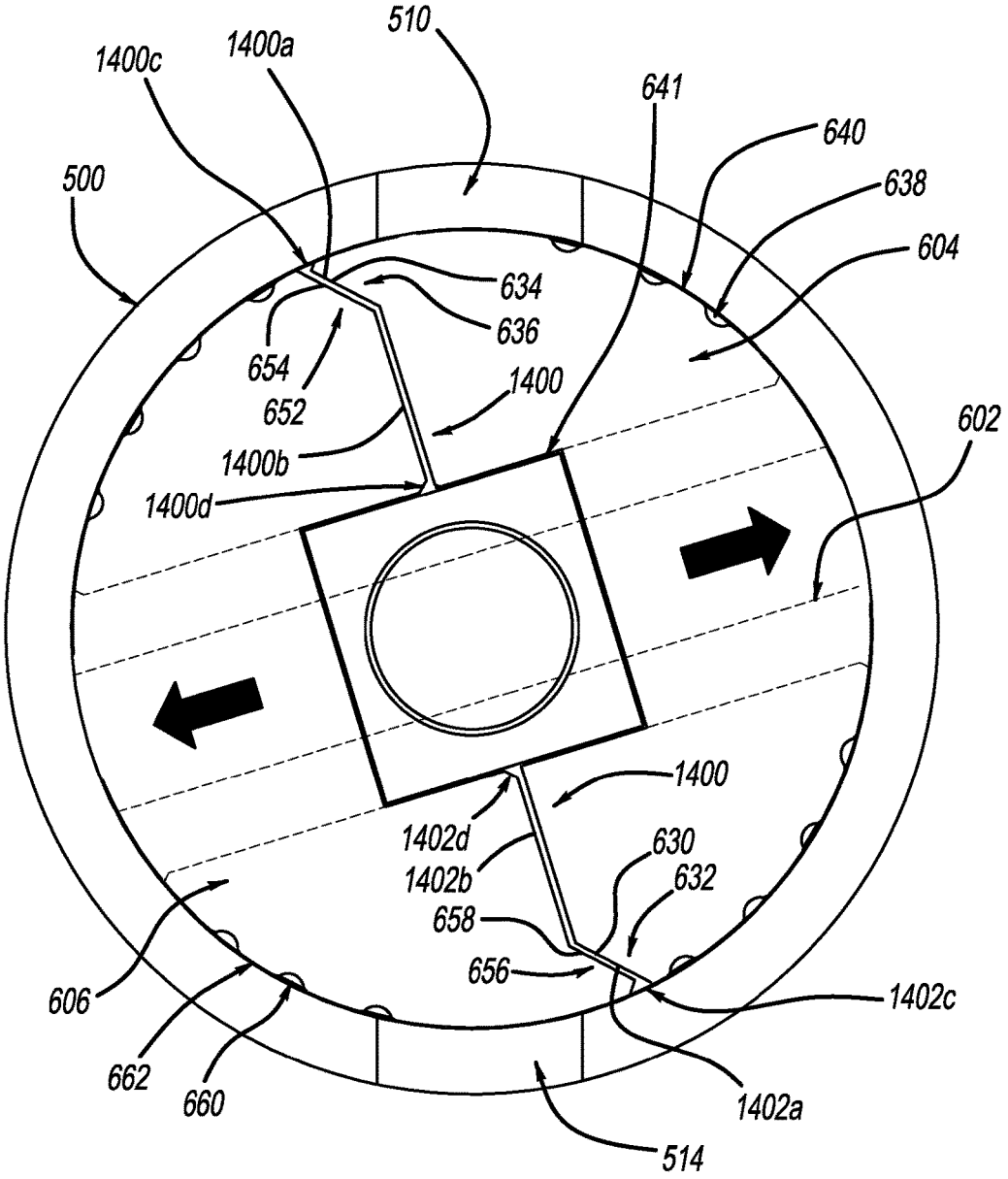
FIG. 11A is a sectional schematic view of an intake valve body of a rotary valve internal combustion engine system, in accordance with a fourteenth embodiment of the present invention.
Figure 11B:
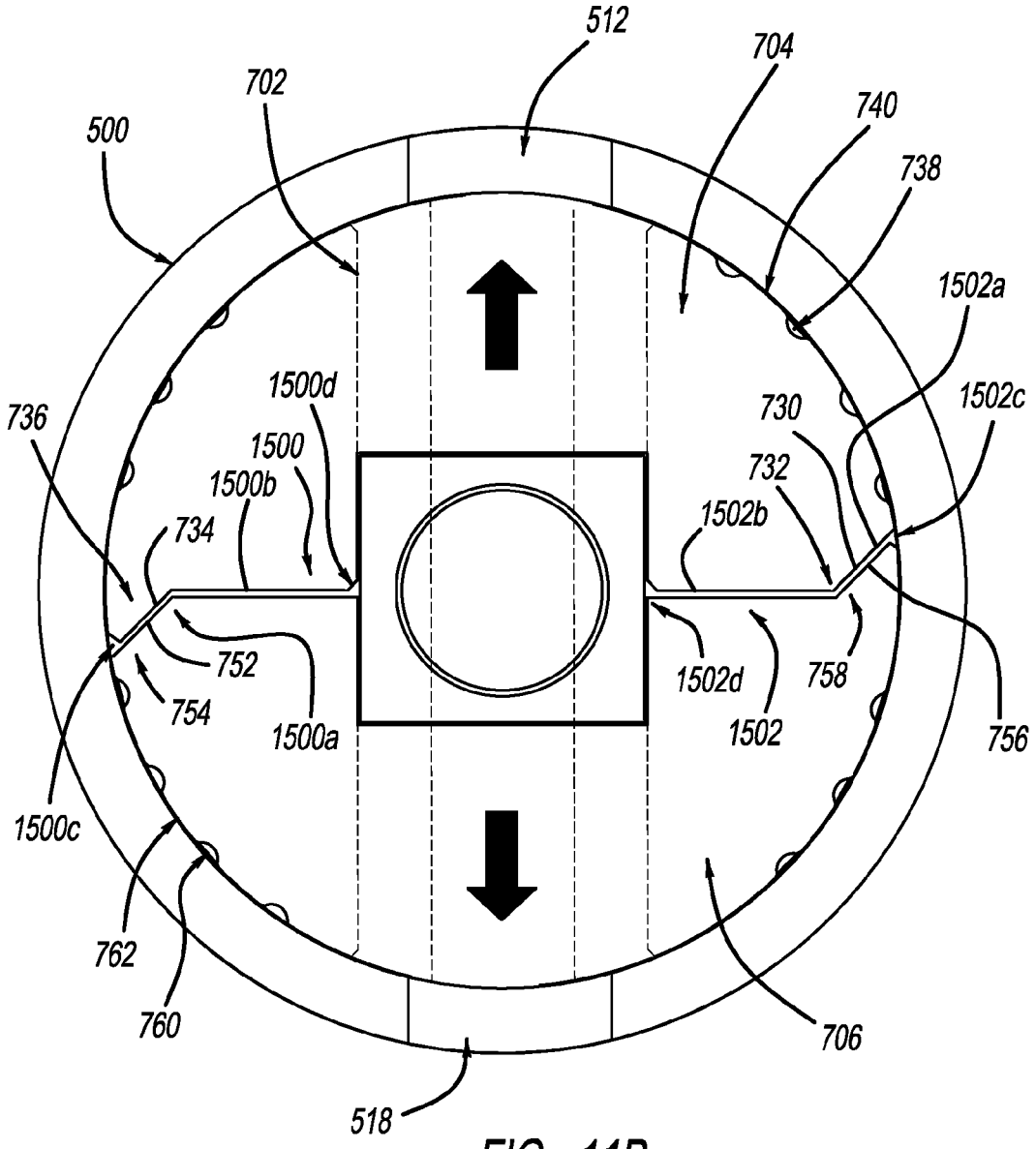
FIG. 11B is a sectional schematic view of an exhaust valve body of a rotary valve internal combustion engine system, in accordance with a fifteenth embodiment of the present invention.

Referring specifically to FIGS. 11A-11B, the present invention provides a system and method for sealing off the combustion forces and gases within the combustion chamber of the cylinder by utilizing these very combustion forces and gases to expand the rotor shells that make up the actual rotor body of the rotary valve system of the present invention. In this manner, the present invention employs an unconventional "dynamic" sealing system and method that completely eliminates the need for a separate "static" seal member that will need to be replaced in a relatively short period of time.

In FIG. 11A, there is shown a sectional view of intake valve body 602 in a "closed" position relative to upper intake port 510 and lower intake port 514 of housing 500. In FIG. 11B, there is shown a sectional view of exhaust valve body 702 in an "open" position relative to upper exhaust port 512 and lower exhaust port 518 of housing 500.

With respect to FIG. 11A, first intake rotor shell portion 604 and second intake rotor shell portion 606 are positioned in proximity to one another such that a plurality of separation gap portions 1400, 1402, respectively, are formed therebetween. Each of separation gap portions 1400, 1402, respectively, may include at least one angled pathway 1400*a*, 1402*a*, respectively, and at least one straight pathway 1400*b*, 1402*b*, respectively. It should be appreciated that other configurations other than angled and/or straight may be employed, such as curved, bowed, arcuate, and/or the like. Additionally, each of separation gap portions 1400, 1402, respectively, may include an opening 1400*c*, 1402*c*, respectively, that permits a fluid (e.g., combustion gases) to enter into separation gap portions 1400, 1402, respectively. Although openings 1400*c*, 1402*c*, respectively, are shown as presenting an angled opening, it should be appreciated that other configurations may be employed. Furthermore, each of separation gap portions 1400, 1402, respectively, may include an egress 1400*d*, 1402*d*, respectively, that permits a fluid (e.g., combustion gases) to exit from separation gap portions 1400, 1402, respectively. Although egresses 1400*d*, 1402*d*, respectively, are shown as presenting an angled opening, it should be appreciated that other configurations may be employed. The intended purpose of these separation gap portions 1400, 1402, respectively, is to provide an indirect, maze-like or labyrinth-like pathway to prevent the explosive combustion gases from easily escaping from combustion chamber 1108 to any appreciable degree.

Figure 6A:
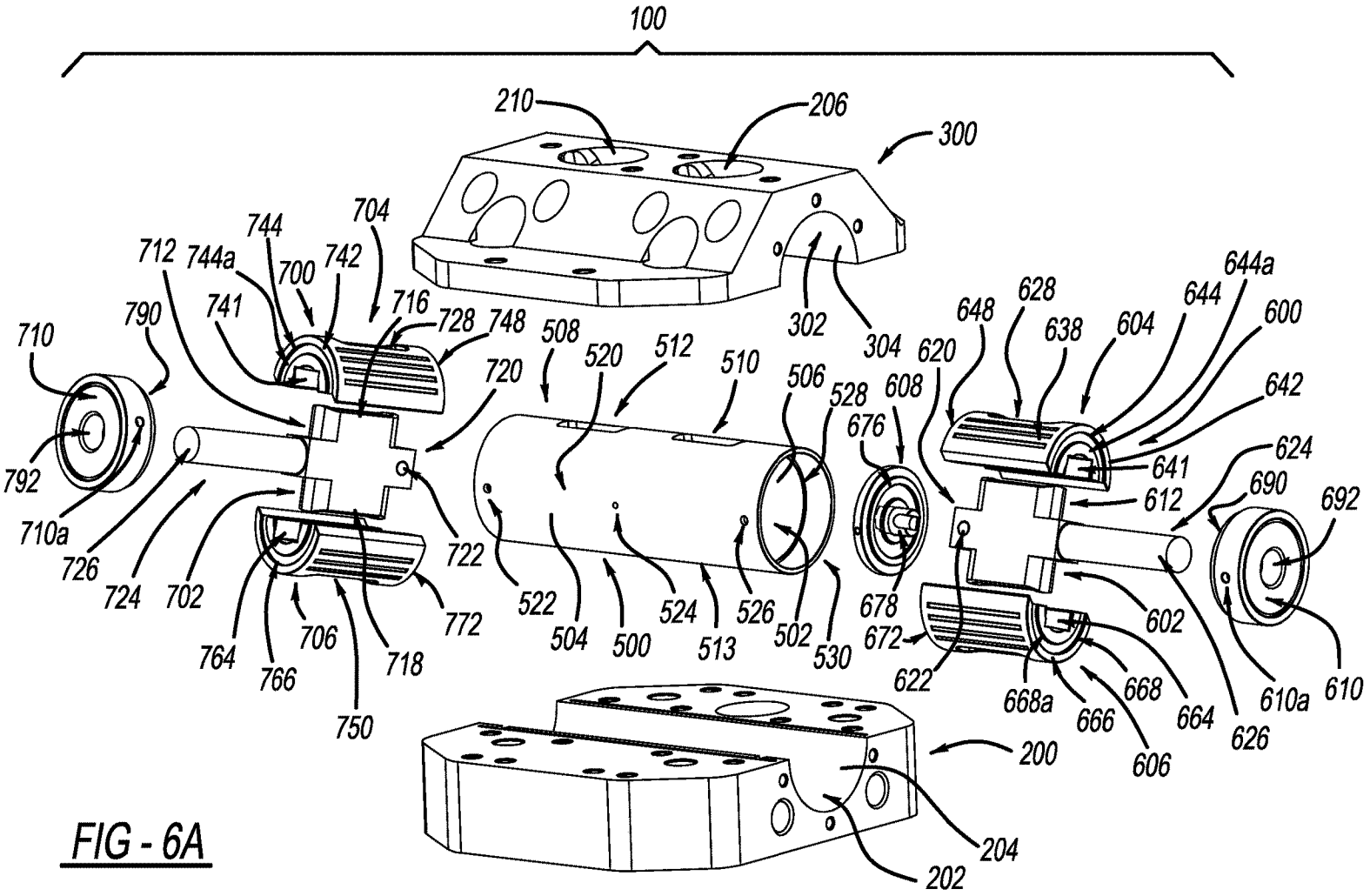
FIG. 6A is an exploded schematic view of a rotary valve assembly of a rotary valve internal combustion engine system, in accordance with an eighth embodiment of the present invention.
Figure 6B:
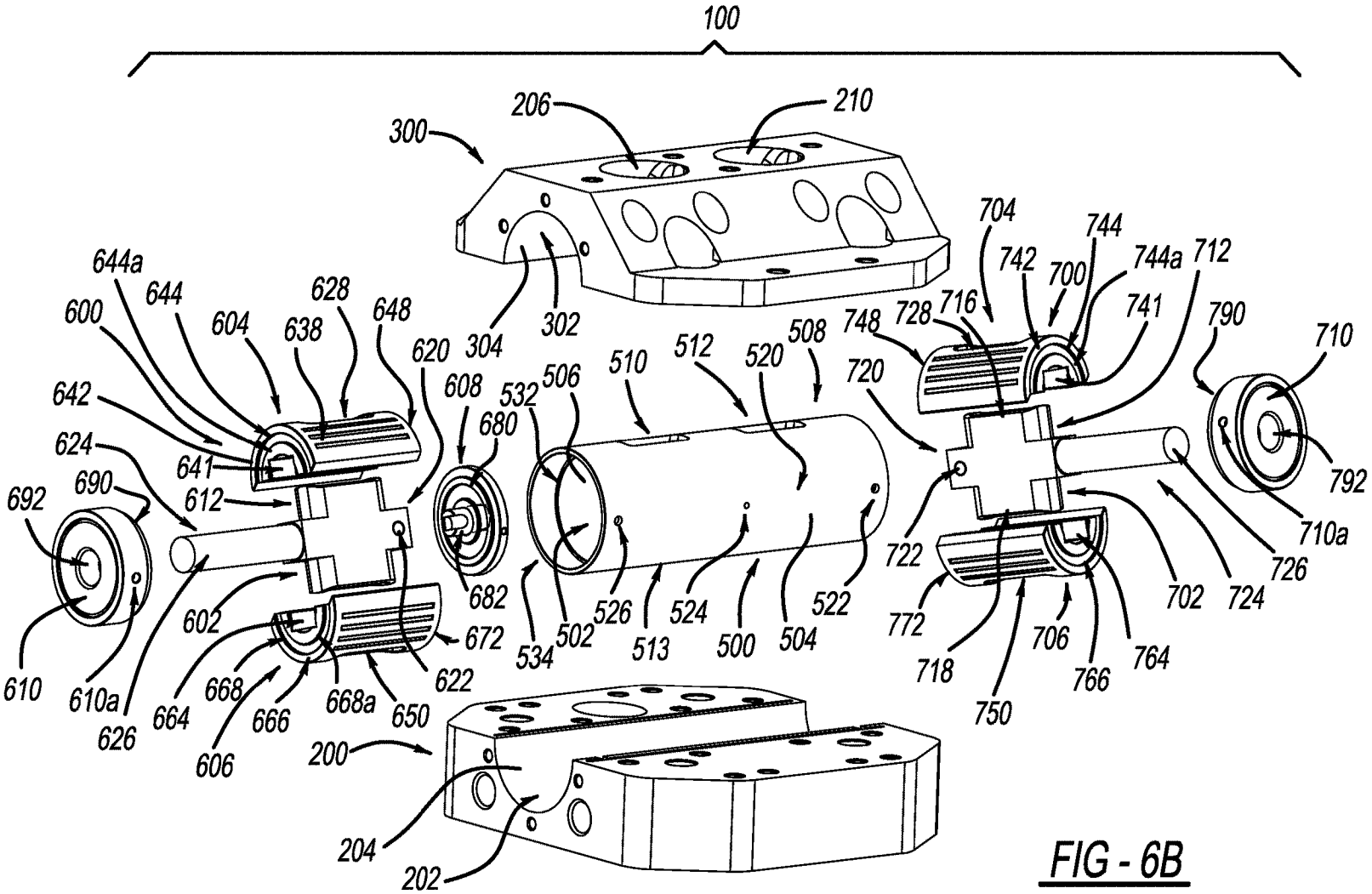
FIG. 6B is a second exploded schematic view of a rotary valve assembly of a rotary valve internal combustion engine system, in accordance with a ninth embodiment of the present invention.

Additionally, "surface" or "buffer" grooves 638 of first intake rotor shell portion 604 and "surface" or "buffer" grooves 660 of second intake rotor shell portion 606 (e.g., as best seen in FIGS. 6A-6B) provide another indirect pathway to prevent the explosive combustion gases from easily escaping from combustion chamber 1108 to any appreciable degree.

Furthermore, "side" grooves 644, 646, respectively, of first intake rotor shell portion 604 and "side" grooves 668, 670, respectively, of second intake rotor shell portion 606 (e.g., as best seen in FIGS. 6A-6B) provide another indirect pathway to prevent the explosive combustion gases from easily escaping from the combustion chamber 1108 to any appreciable degree.

With respect to FIG. 11B, first exhaust rotor shell portion 704 and second exhaust rotor shell portion 706 are positioned in proximity to one another such that a plurality of separation gap portions 1500, 1502 are formed therebetween. Each of separation gap portions 1500, 1502, respectively, may include at least one angled pathway 1500*a*, 1502*a*, respectively, and at least one straight pathway 1500*b*, 1502*b*, respectively. It should be appreciated that other configurations other than angled and/or straight may be employed, such as curved, bowed, arcuate, and/or the like. Additionally, each of separation gap portions 1500, 1502, respectively, may include an opening 1500*c*, 1502*c*, respectively, that permits a fluid (e.g., combustion gases) to enter into separation gap portions 1500, 1502, respectively. Although openings 1500*c*, 1502*c*, respectively, are shown as presenting an angled opening, it should be appreciated that other configurations may be employed. Furthermore, each of separation gap portions 1500, 1502, respectively, may include an egress 1500*d*, 1502*d*, respectively, that permits a fluid (e.g., combustion gases) to exit from separation gap portions 1500, 1502, respectively. Although egresses 1500*d*, 1502*d*, respectively, are shown as presenting an angled opening, it should be appreciated that other configurations may be employed. The intended purpose of these separation gap portions 1500, 1502, respectively, is to provide an indirect, maze-like or labyrinth-like pathway to prevent the explosive combustion gases from easily escaping from combustion chamber 1108 to any appreciable degree.

Additionally, "surface" or "buffer" grooves 738 of the first exhaust rotor shell portion 704 and "surface" or "buffer" grooves 760 of second exhaust rotor shell portion 706 (e.g., as best seen in FIGS. 6A-6B) provide another indirect pathway to prevent the explosive combustion gases from easily escaping from combustion chamber 1108 to any appreciable degree.

Furthermore, "side" grooves 744, 746, respectively, of first exhaust rotor shell portion 704 and "side" grooves 768, 770, respectively, of second exhaust rotor shell portion 706 (e.g., as best seen in FIGS. 6A-6B) provide another indirect pathway to prevent the explosive combustion gases from easily escaping from combustion chamber 1108 to any appreciable degree.

By way of a non-limiting example, during the intake stroke, as previously described, the vacuum pressure created inside the combustion chamber causes one or more of the respective rotor shells, especially one of first exhaust rotor shell portion 704 and/or second exhaust rotor shell portion 706 to piston assembly 1204, to expand, thus forcing the respective shell portions, especially one of first exhaust rotor shell portion 704 and/or second exhaust rotor shell portion 706 closest to piston assembly 1204, outwardly towards and/or against inner surface 506 of housing 500, thus creating a positive seal therebetween (e.g., as shown by the two large arrows in FIGS. 11A-11B) and sealing off combustion chamber 1108.

By way of a non-limiting example, during the compression stroke, as previously described, the rising pressure (e.g., positive pressure) created inside the combustion chamber causes all of the respective rotor shells (e.g., first intake rotor shell portion 604, second intake rotor shell portion 606, first exhaust rotor shell portion 704 and second exhaust rotor shell portion 706), to expand, thus forcing all of the respective shell portions outwardly towards and/or against inner surface 506 of housing 500, thus creating a positive seal therebetween (e.g., as shown by the two large arrows in FIGS. 11A-11B) and sealing off combustion chamber 1108.

By way of a non-limiting example, during the power stroke, explosive gas pressure further forces all of the respective rotor shells to equally expand outwardly to seal even more effectively against inner surface 506 of housing 500, thus creating an even stronger positive seal therebetween (e.g., as shown by the two large arrows in FIGS. 11A-11B).

By way of a non-limiting example, as the piston assembly reaches BDC of the power stroke, the rotating rotor assembly now allows the exhaust port runner to communicate with the machined ports in housing 500, allowing the spent gases to exit out of the cylinder, e.g., through exhaust manifold 1300 (e.g., for further processing by the vehicle's exhaust system, e.g., by the vehicle's catalytic converter).

This expanding rotor shell design is also self-compensating for wear. As the respective rotor shells wear, the combustion gases force the respective rotor shells out further and against inner surface 506 of housing 500 and separation gap portions 1400, 1402, 1500, 1502, respectively, are enlarged. As previously described, separation gap portions 1400, 1402, 1500, 1502, respectively, exist between each of the two rotor shell halves to allow for the combustion pressure to enter into this area and to act upon the rotor shells by forcing them outward and against inner surface 506 of housing 500, thus creating a positive seal therebetween (e.g., as shown by the two large arrows in FIGS. 11A-11B). In fact, as the pressure increases inside combustion chamber 1108, and into separation gap portions 1400, 1402, 1500, 1502, respectively, between each of the pair of rotors shells, this also increases the sealing pressure between the pair of rotor shells and inner surface 506 of housing 500.

The rotor shells that float onto the rotating runner shafts are preferably made from a ceramic material that requires no lubrication. As previously described, these rotor shells may be designed with certain geometries that trap and redirect the combustion gases to force the respective shells outward and against inner surface 506 of housing 500 (e.g., as shown by the two large arrows in FIGS. 11A-11B). The geometry created preferably forms a maze or labyrinth type of a seal that prevents the explosive combustion gases from easily escaping from combustion chamber 1108 to any appreciable degree. Separation gap portions 1400, 1402, 1500, 1502, respectively, that exist between each of the pair of rotor shells channels this combustion gas pressure to expand the rotor shells. As the rotor shells wear, this separation gap automatically gets larger so as to be self-adjusting or compensating for wear within this system. As previously described, the rotor shells also have grooved channels at both ends of the shell that are positioned to allow the rotor shell to rotate freely about the matching grooves in bearing support housings 611, 711, respectively, sealing off the ends of hollow tubular housing 500. This also acts as another labyrinth or maze that prevents the combustion pressure and gases from easily escaping from combustion chamber 1108 to any appreciable degree. As previously described, the outer surface of the rotor shell may also have "buffer" grooves formed thereon to limit the travel of combustion pressure across this surface. The "buffer" grooves may redirect the combustion pressure towards the sides of the rotor shell and prevents this gas pressure from continuing to travel over the face of the rotor shell. The buffer grooves also may reduce the total surface area of the respective rotor shells, thereby reducing the friction between the respective rotor shells and the housing. The combination, depth and spacing of the "buffer" grooves may be dependent upon each individual engine application.

Figure 12:
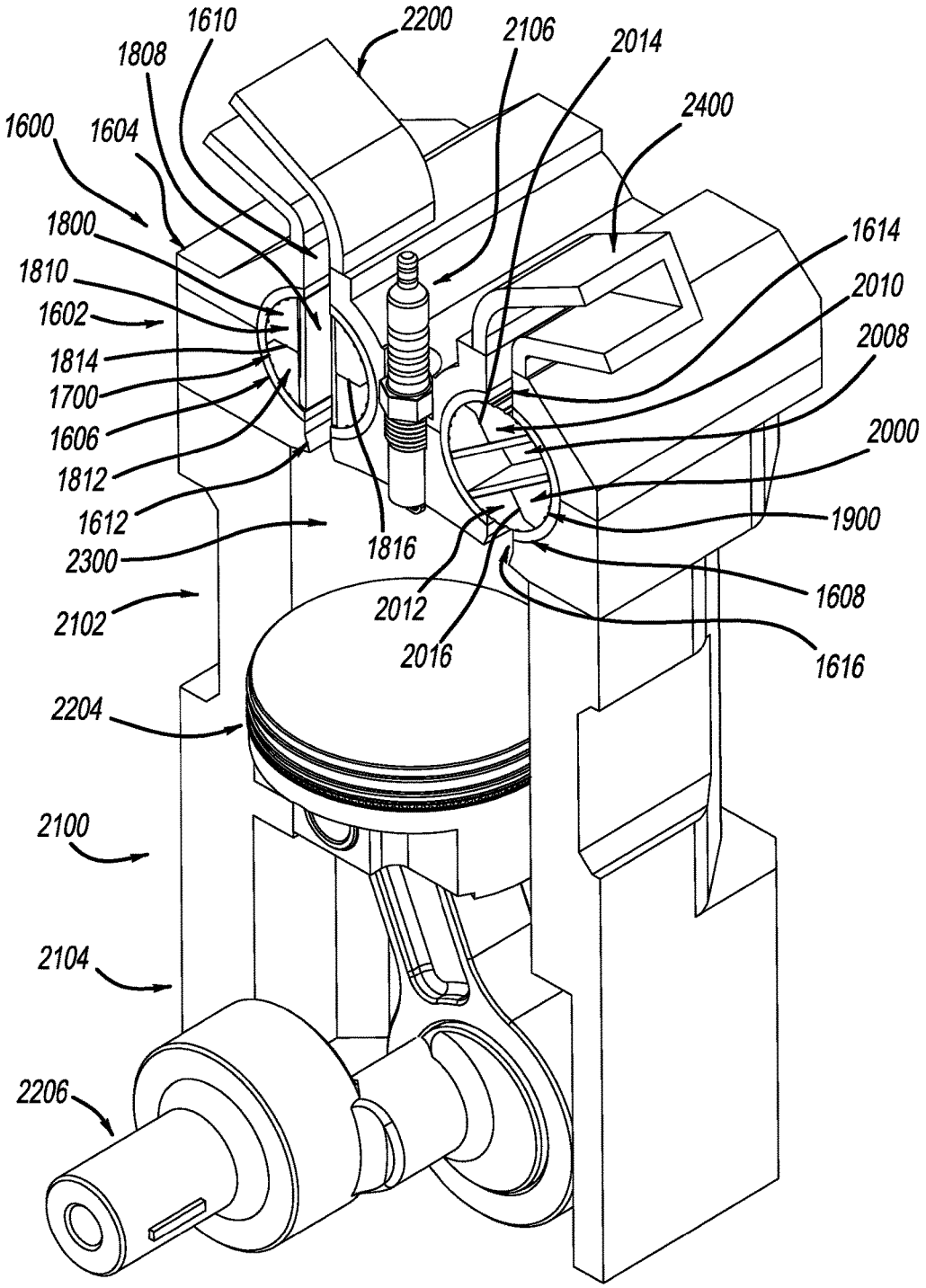
FIG. 12 is a partial sectional schematic view of an alternative rotary valve internal combustion engine system having separate intake and exhaust valve bodies, in accordance with a sixteenth embodiment of the present invention.

Referring specifically to FIG. 12, an alternative cylinder head assembly 1600 is provided for engine system 10. Cylinder head assembly 1600 may include a lower cylinder head member 1602 and an upper cylinder head member 1604, wherein lower cylinder head member 1602 and upper cylinder head member 1604 may be operable to be brought into engagement with one another and may be secured to one another through any number of suitable fastening members, such as but not limited to screws, bolts and/or the like. Lower cylinder head member 1602 and upper cylinder head member 1604, brought into engagement with one another, may define a first circular through bore 1606 extending along a length (e.g., the entire length) of lower cylinder head member 1602 and upper cylinder head member 1604 and a second circular through bore 1608 extending along a length (e.g., the entire length) of lower cylinder head member 1602 and upper cylinder head member 1604. Alternatively, cylinder head assembly 1600 may be formed (e.g., milled) from a single, monolithic piece of an appropriate material, rather than employing separate lower and upper cylinder head members 1602, 1604, respectively. There may also be engine designs that utilize a common, one-piece lower cylinder head portion that may be employed with multiple or individual upper cylinder head portions, allowing an engine designer to combine a desired upper cylinder head portion with the common, one-piece lower cylinder head portion.

In this particular embodiment, instead of a single housing receiving both the intake and exhaust rotor assemblies, there is provided a first housing 1700 (receivable in bore 1606) that exclusively receives only a single intake rotor assembly 1800 (essentially identical to the previously described intake rotor assembly) and a second housing 1900 (receivable in bore 1608) that exclusively receives only a single exhaust rotor assembly 2000 (essentially identical to the previously described exhaust rotor assembly). The use of a center plate is not necessarily required in this embodiment, but may be used optionally to prevent any dilution or crossover, e.g., from the intake of one cylinder assembly to the intake of another cylinder assembly and/or the exhaust of one cylinder assembly to the exhaust of another cylinder assembly, and/or from the intake of one cylinder assembly to the exhaust of another cylinder assembly. Alternatively, a surface may be milled on the inner surface of one or more of the bores that is operable to function as a "center plate" like member. As with the previously described embodiment, the respective housings 1700, 1900, respectively, are fixed with respect to bores 1606, 1608, respectively, so that housings 1700, 1900, respectively, do not rotate. Additionally, as with the previously described embodiment, intake rotor assembly 1800 is operable to rotate within housing 1700 and exhaust rotor assembly 2000 is operable to rotate within housing 1900. The primary difference between the previously described housing 500 and housings 1700, 1900, respectively, is that only one set of spaced and opposed upper and lower ports are provided on each of housings 1700, 1900, respectively. For example, first housing 1700 may include an area defining an upper intake port 1702 and a spaced and opposed lower intake port 1704, axially aligned with each other, and second housing 1900 may include an area defining an upper exhaust port 1902 and a spaced and opposed lower exhaust port 1904, axially aligned with each other.

Referring to FIGS. 13-16, a description will be provided of the function of cylinder head assembly 1600 during a four stroke operation of engine system 10. In these views, cylinder head assembly 1600 is shown as being mounted, via any number of suitable fasteners such as, but not limited to screws, bolts and/or the like, to a combined cylinder block/crankcase 2100, comprising a cylinder block portion 2102 and a crankcase portion 2104. Additionally, a spark plug 2106 is provided for delivering an electric current (e.g., from an ignition system) to a combustion chamber 2300 to ignite a compressed fuel/air mixture by an electric spark.

Figure 13:
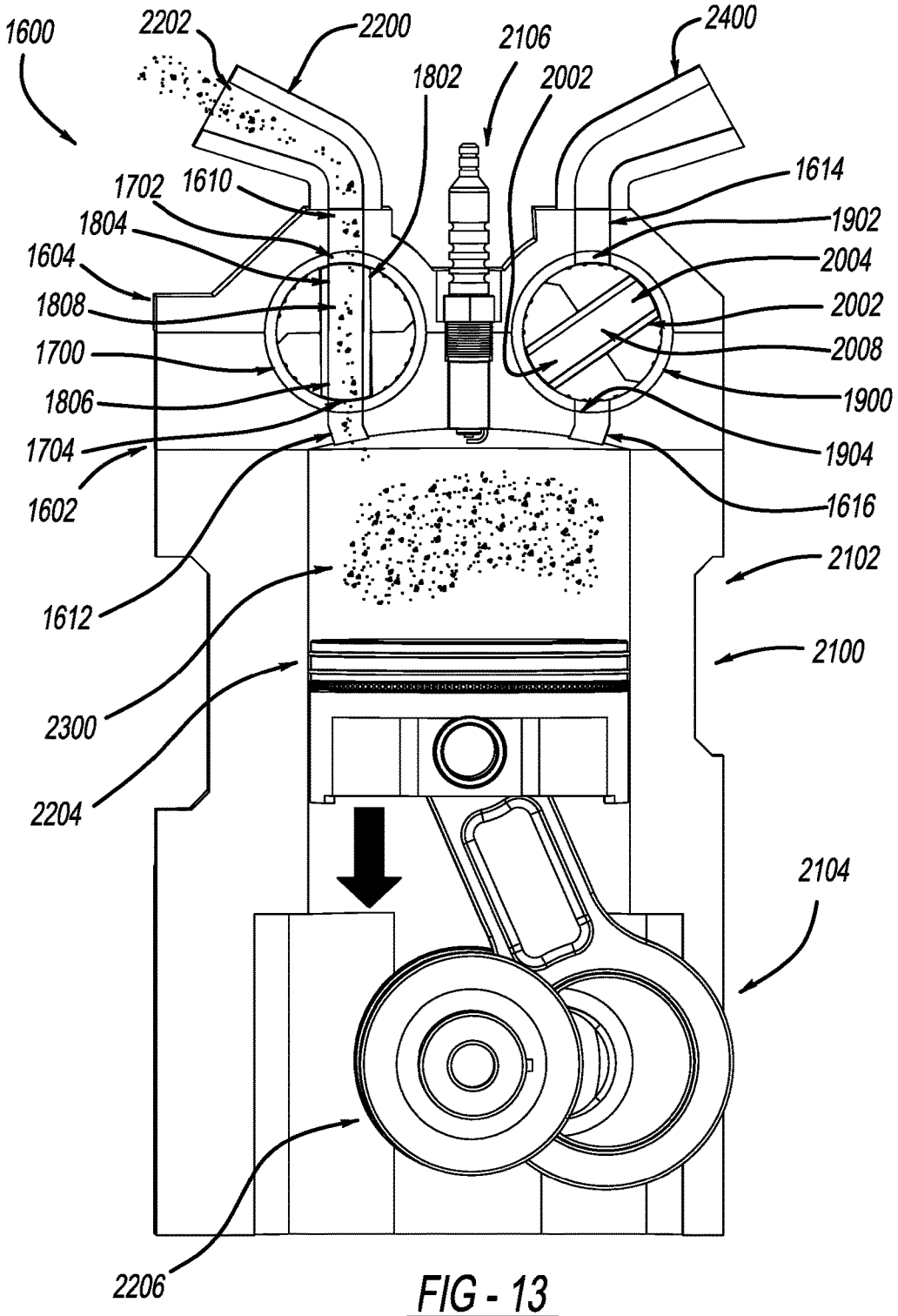
FIG. 13 is a partial sectional schematic view of the alternative rotary valve internal combustion engine system depicted in FIG. 12 during an intake stroke, in accordance with a seventeenth embodiment of the present invention.

Referring specifically to FIG. 13, an intake or induction stroke is shown, wherein intake rotor body 1802 is shown in the open position, wherein a first open end 1804 and a second open end 1806 of a through bore 1808 of intake rotor body 1802 may be brought into fluid communication with the intake pathway of the engine system, specifically bore 1610 formed through a portion of upper cylinder head member 1604 and bore 1612 formed through a portion of lower cylinder head member 1602. In this manner, a continuous fluid pathway may be established from an intake manifold 2200, through bore 1610, through port 1702, through first open end 1804, through bore 1808, through second open end 1806, through port 1704, through bore 1612, and into a combustion chamber 2300. At the same time, it should be noted that exhaust rotor body 2002 is shown in the closed position. In practice, an air/fuel mixture 2202 would be charged through bore 1610, through port 1702, through first open end 1804, through bore 1808, through second open end 1806, through port 1704, through bore 1612, and into combustion chamber 2300. This stroke of piston assembly 2204 would typically begin at top dead center (TDC) and end at bottom dead center (BDC). In this stroke, intake rotor body 1802 must be in the open position while piston assembly 2204 pulls air-fuel mixture 2202 into combustion chamber 2300 by producing vacuum pressure into combustion chamber 2300 through its downward motion, as indicated by the arrow. As exhaust rotor body 2002 is in the closed position, air/fuel mixture 2202 is preventing from escaping from combustion chamber 2300.

Figure 14:
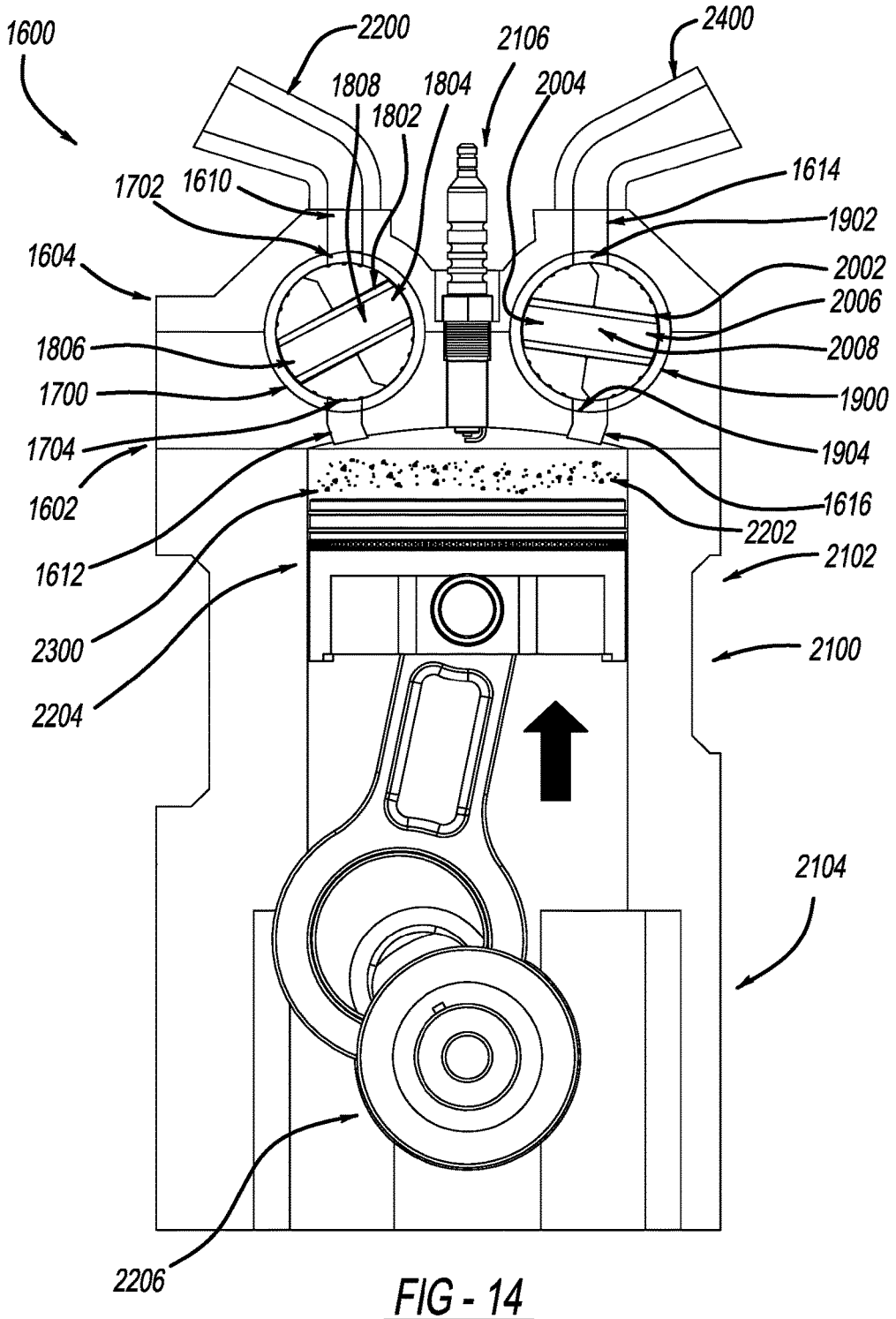
FIG. 14 is a partial sectional schematic view of the alternative rotary valve internal combustion engine system depicted in FIG. 12 during a compression stroke, in accordance with an eighteenth embodiment of the present invention.

Referring specifically to FIG. 14, a compression stroke is shown, wherein intake rotor body 1802 and exhaust rotor body 2002 are both shown in the closed position. In practice, air/fuel mixture 2202 is rapidly and forcefully compressed by rising piston assembly 2204. This stroke typically begins at BDC, or just at the end of the suction stroke, and ends at TDC. In this stroke, piston assembly 2204 travels upwardly and compresses air-fuel mixture 2202 in preparation for ignition during the power stroke, as indicated by the arrow.

Figure 15:
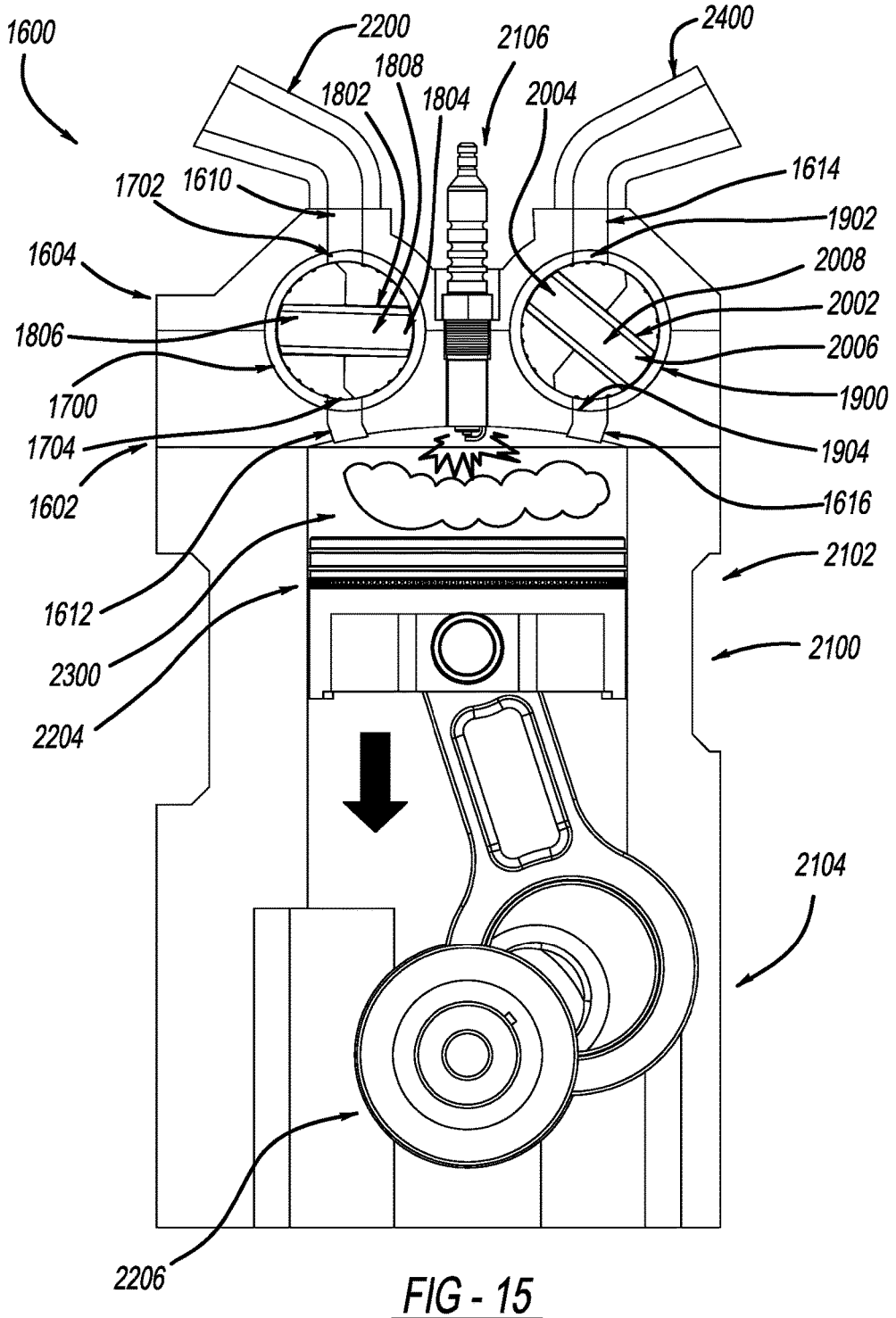
FIG. 15 is a partial sectional schematic view of the alternative rotary valve internal combustion engine system depicted in FIG. 12 during a power stroke, in accordance with a nineteenth embodiment of the present invention.

Referring specifically to FIG. 15, a power (or combustion) stroke is shown, wherein intake rotor body 1802 and exhaust rotor body 2002 are still both shown in the closed position. In practice, this is the start of the second revolution of the four stroke cycle. At this point, a crankshaft 2206 has completed a full 360 degree revolution. While piston assembly 2204 is near TDC (i.e., the end of the compression stroke), compressed air-fuel mixture 2202 is ignited by spark plug 2106 (e.g., in a gasoline or gasoline blend engine) or by heat generated by high compression (e.g., in diesel engines) producing a rapidly expanding gas, forcefully returning piston assembly 2204 to BDC, as indicated by the arrow. This stroke produces mechanical work from the engine to turn crankshaft 2206.

Figure 16:
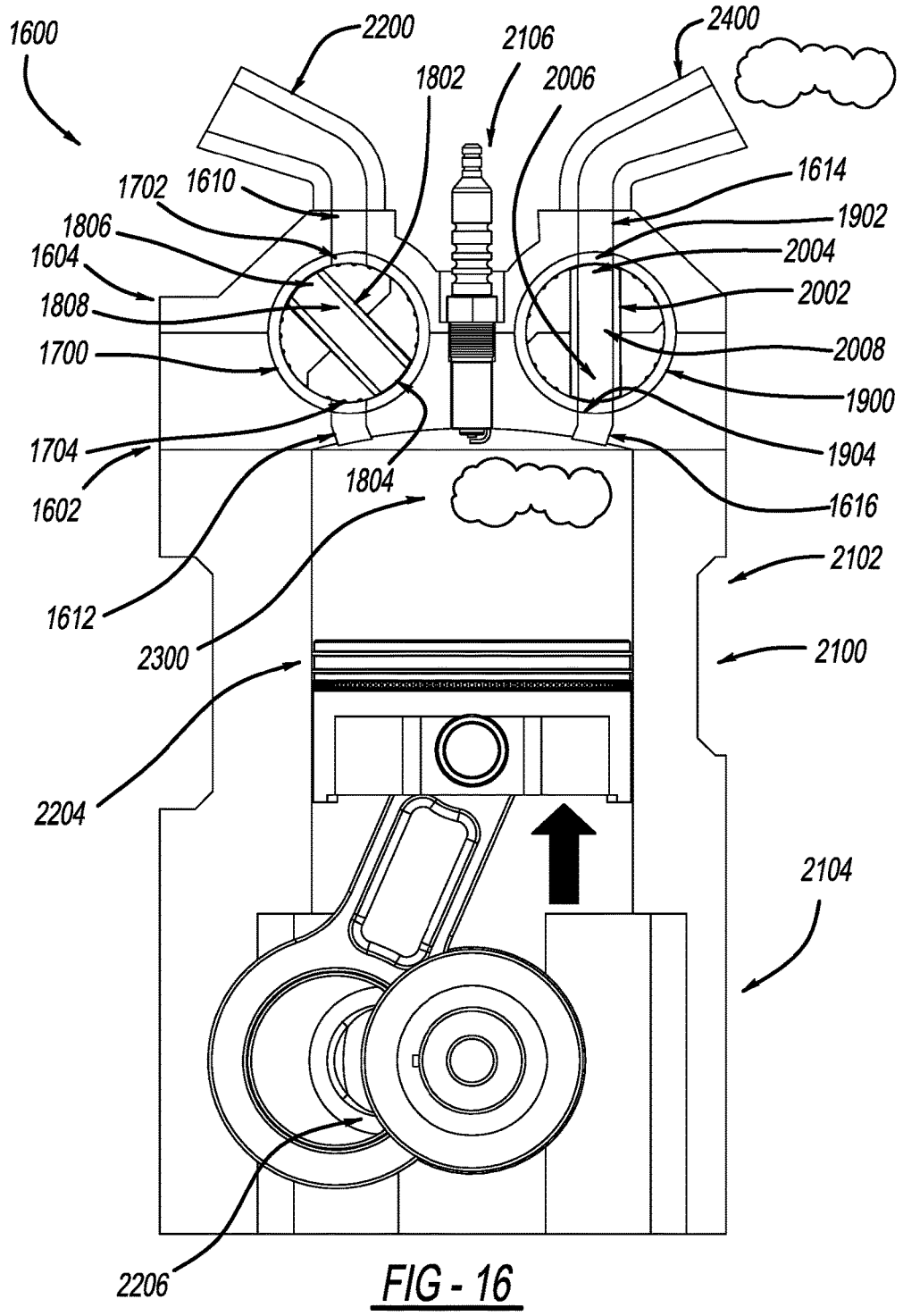
FIG. 16 is a partial sectional schematic view of the alternative rotary valve internal combustion engine system depicted in FIG. 12 during an exhaust stroke, in accordance with a twentieth embodiment of the present invention.

Referring specifically to FIG. 16, an exhaust stroke is shown, wherein intake rotor body 1802 remains closed; however, exhaust rotor body 2002 is shown in the open position. Specifically, a first open end 2004 and a second open end 2006 of a through bore 2008 of exhaust rotor body 2002 may be brought into fluid communication with the exhaust pathway of the engine system, specifically a bore 1614 formed through a portion of upper cylinder head member 1604 and a bore 1616 formed through a portion of lower cylinder head member 1602. In this manner, a continuous fluid pathway may be established from an exhaust manifold 2400, through bore 1614, through port 1902, through first open end 2004, through bore 2008, through second open end 2006, through port 1904, through bore 1616, and into combustion chamber 2300. In practice, during the exhaust stroke, piston assembly 2204 once again returns from BDC to TDC while exhaust rotor body 2002 is open, as indicated by the arrow. This action expels the spent air-fuel mixture 2202 through the exhaust manifold.

As the intake and exhaust rotor assemblies of cylinder head assembly 1600 are essentially identical to the intake and exhaust rotor assemblies of the previously described embodiment, cylinder head assembly 1600 also employs the same system and method for sealing off the combustion forces and gases within the combustion chamber of the respective cylinder by utilizing these very combustion forces and gases to expand the respective rotor shells that make up the actual rotor bodies of the rotary valve system of the present invention.

Again referring specifically to FIG. 12, a first intake rotor shell portion 1810 and a second intake rotor shell portion 1812 are positioned in proximity to one another such that a plurality of separation gap portions 1814, 1816, respectively, are formed therebetween. As with the previously described embodiment, each of separation gap portions 1814, 1816, respectively, may include at least one angled pathway, respectively, and at least one straight pathway, respectively. It should be appreciated that other configurations other than angled and/or straight may be employed, such as curved, bowed, arcuate, and/or the like. The intended purpose of these separation gap portions 1814, 1816, respectively, is to provide an indirect, maze-like or labyrinth-like pathway to prevent the explosive combustion gases from easily escaping from combustion chamber 2300 to any appreciable degree.

Still referring specifically to FIG. 12, a first exhaust rotor shell portion 2010 and a second exhaust rotor shell portion 2012 are positioned in proximity to one another such that a plurality of separation gap portions 2014, 2016, respectively, are formed therebetween. As with the previously described embodiment, each of separation gap portions 2014, 2016, respectively, may include at least one angled pathway, respectively, and at least one straight pathway, respectively. It should be appreciated that other configurations other than angled and/or straight may be employed, such as curved, bowed, arcuate, and/or the like. The intended purpose of these separation gap portions 2014, 2016, respectively, is to provide an indirect, maze-like or labyrinth-like pathway to prevent the explosive combustion gases from easily escaping from combustion chamber 2300 to any appreciable degree.

By way of a non-limiting example, during the intake stroke, as previously described in conjunction with the single housing embodiment, the vacuum pressure created inside combustion chamber 2300 causes one or more of the respective rotor shells, especially one of first exhaust rotor shell portion 2010 and/or second exhaust rotor shell portion 2012 closest to piston assembly 2204, to expand, thus forcing the respective shell portions, especially one of first exhaust rotor shell portion 2010 and/or second exhaust rotor shell portion 2012 closest to piston assembly 2204, outwardly towards and/or against an inner surface of housing 1900, thus creating a positive seal therebetween (e.g., as shown by the two large arrows in either of FIG. 11A-11B in conjunction with the single housing embodiment) and sealing off combustion chamber 2300.

By way of a non-limiting example, during the compression stroke, as previously described in conjunction with the single housing embodiment, the rising pressure (e.g., positive pressure) created inside the combustion chamber 2300 causes all of the respective rotor shells (e.g., first intake rotor shell portion 1810, second intake rotor shell portion 1812, first exhaust rotor shell portion 2010 and second exhaust rotor shell portion 2012), to expand, thus forcing all of the respective shell portions outwardly towards and/or against the inner surface of housings 1700, 1900, respectively, thus creating a positive seal therebetween (e.g., as shown by the two large arrows in either of FIG. 11A-11B in conjunction with the single housing embodiment) and sealing off combustion chamber 2300.

By way of a non-limiting example, during the power stroke, explosive gas pressure further forces all of the respective rotor shells to equally expand outwardly to seal even more effectively against the inner surface of housings 1700, 1900, respectively, thus creating an even stronger positive seal therebetween (e.g., as shown by the two large arrows in either of FIG. 11A-11B in conjunction with the single housing embodiment) and sealing off combustion chamber 2300.

By way of a non-limiting example, as the piston assembly reaches BDC of the power stroke, the rotating rotor assembly now allows the exhaust port runner to communicate with the machined ports in housing 1900, allowing the spent gases to exit out of the cylinder, e.g., through exhaust manifold 2400 (e.g., for further processing by the vehicle's exhaust system, e.g., by the vehicle's catalytic converter).

The benefits of the rotary valve internal combustion engine system of the present invention are, without limitation, increased horsepower and torque, improved airflow and rate of aspiration, higher operating RPM without the worry of a highly stressed poppet valve arrangement to fail, no poppet valves to float, zero piston to valve clearance issues because no parts of the rotary valve internal combustion engine system of the present invention enters into the combustion chamber. Additionally, higher compression ratios can be tolerated without the need for higher octane fuels, slower valve train speeds because this system operates at one quarter crankshaft speed, no lubricating oil is required for this type of valve system, and because the rotary shaft speed is much slower than a conventional poppet valve train, less wear is present for these components. Approximately 50% fewer parts are required for this type of rotary valve internal combustion engine system of the present invention versus conventional poppet valve systems. Because the rotary valve internal combustion engine system of the present invention has much better airflow potential than conventional poppet valve systems, a single intake and exhaust rotor may replace multiple intake and exhaust valves in a conventional multiple valve cylinder. Current production engines have as many as five valves per cylinder, and usually three intake valves and two exhaust valves per cylinder, whereas, a single rotor for the intake and one for the exhaust is all that is required for the same or better airflow in conjunction with the rotary valve internal combustion engine system of the present invention.

Another benefit of this type of cylinder head and rotary valve system is that the entire rotary valve system can be completely serviced or replaced without removing the cylinder head from the engine. In fact, each individual cylinder within the engine may be serviced or replaced individually with rotary valve modules that are independent from one another within the engine. A technician may be able to remove and replace the rotary valve as a cartridge per cylinder, or even per intake or exhaust per cylinder, in the case of a dual plane rotor design. This greatly benefits the technician, as well as the vehicle owner, because the time to repair the engine with this type of valve system is much less labor intensive than a conventional poppet valve train system. With a conventional poppet valve system, the entire cylinder head needs to be removed from the engine to service any one of the poppet valves. The seal between the cylinder head and engine block is typically damaged, thus requiring that coolant and oils be drained and replaced, the head gasket typically needs to be replaced, and sometimes all of the head bolts need replacing, especially if torque issues are present. The added parts costs and labor is significantly more than servicing and replacement of any or all of the rotary valve modules of the present invention.

Furthermore, the vertical height of the engine with a rotary valve internal combustion engine system of the present invention is lower than a conventional poppet valve engine because of the height and location of the conventional valve stems, rocker arms, valve covers, and/or the like. This would allow for more room under the automobile hood for packaging and placement of other vehicle components, a lower vertical center of gravity, better vehicle handling, safer for pedestrian to vehicle front end collisions, and so forth.

Additionally, engine oil change intervals would be longer due to the fact that the engine oil is no longer required to lubricate, clean and cool a conventional poppet valve train system. The engine oil would remain in the crankcase (e.g., the oil sump) and only be required for lubrication of the lower engine rotating assembly. This would also allow for less oil to be used in each engine because the engine oil does not have to travel up to the top of the engine and back down through to the oil pump. This also prevents the engine oil from turning to sludge within certain engines that typically have slower oil return paths, and prevents returning oil from getting back to the oil pump during high RPM conditions that can actually starve the oil pump for oil and can cause engine damage as a result. With less oil requirements, designers could utilize smaller oil pans, less weight, better ground clearance, cheaper production and manufacturing costs, less expensive and fewer oil changes for the end user or vehicle owner, be better for the environment, and so forth.

It should be understood that the rotating rotor assembly may be connected to the crankshaft of the engine, e.g., via one or more chain drives or belts 800 interconnecting one or more rotating shaft pulleys or sprockets 802 and one or more crankshaft pulleys or sprockets 804, and may permit operation at one quarter crankshaft speed (as opposed to half crankshaft speed of conventional poppet valve and certain conventional rotary valve engines). This is possible because the rotors allow intake and exhaust air flow in both directions. This slower rotary valve shaft speed reduces the mechanical and frictional losses of the rotary valve system. It also prevents premature wearing and deterioration of the respective rotor shells.

It should also be appreciated that a servomotor or similar device may be employed to drive the rotation of the shafts of the respective rotor assemblies. The benefit of being able to electrically drive the rotary valve systems of the present invention would be total, individual control of advancing and retarding the intake port timing, separate from the exhaust port timing, to compliment low end torque and upper high RPM horsepower applications. With turbocharged engines, it is beneficial to allow some exhaust gases to exit out relatively early to help "spool up" the turbocharger during low speed acceleration. Improvement of low end torque may be accomplished by advancing the valve timing and improving upper end horsepower by retarding the valving. This may be accomplished quicker and more precisely with servo driven rotary valves, especially on the previously described dual plane (e.g., bores 1700, 1900, respectively) design with independent intake and exhaust control. The engine controller would reference the crankshaft angle and speed, and with Hall Effect type sensors (e.g., crank triggers, flying magnet triggers, toothed Hall Effect reluctors and sensors, and/or the like) determine correct phasing and home the servo motors to correctly index and keep timed the rotary valve action. This would be difficult for a conventional poppet valve, camshaft driven valvetrain because of the required torque to drive the camshafts.

While the present invention has been described with reference to an exemplary embodiment, it will be understood by those skilled in the art that various changes can be made and equivalents can be substituted for elements thereof without departing from the scope of the present invention. In addition, many modifications can be made to adapt a particular situation or material to the teachings of the present invention without departing from the essential scope thereof. Therefore, it is intended that the present invention not be limited to the particular embodiment disclosed as the best mode contemplated for carrying out this present invention, but that the present invention will include all embodiments falling within the scope of the appended claims.

What is claimed is:

1. A cylinder head assembly for a cylinder of a four stroke internal combustion engine, comprising:

a cylinder head member, wherein the cylinder head member includes a first area defining a first exhaust port and a first intake port formed on an upper surface thereof, and a second are defining a second exhaust port and a second intake port formed on a lower surface thereof;

wherein the cylinder head member includes an area defining a circular through bore, wherein the first and second exhaust ports are axially aligned with one another and are in fluid communication with the circular through bore, wherein the first and second intake ports are axially aligned with one another and are in fluid communication with the circular through bore;

an intake rotor assembly including an intake rotor body, a first intake rotor shell portion, a second intake rotor shell portion, wherein each of the first and second intake rotor shell portions include a semi-circular convex outer surface, wherein the intake rotor assembly is rotatably received in the circular through bore of the cylinder head member, wherein the intake rotor assembly is coaxially aligned with the circular through bore of the cylinder head member;

wherein the intake rotor body includes an area defining a through bore extending therethrough, wherein the through bore of the intake rotor body includes a first open end and spaced and opposed second open end, wherein the first and second intake rotor shell portion are in direct opposition to one another so as to envelope a portion of the intake rotor body, wherein when the first and second intake rotor shell portions are in direct opposition to one another a non-linear air gap including at least one chamfered surface at a terminal portion is formed between opposed edge surfaces of the first and second intake rotor shell portions, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions jointly rotate so that the first and second open ends of the through bore of the intake rotor body and the ports of the first and second intake rotor shell portions are in fluid communication with the first and second intake ports; and an exhaust rotor assembly including an exhaust rotor body, a first exhaust rotor shell portion, a second exhaust rotor shell portion, wherein the first and second exhaust rotor shell portions include a semi-circular convex outer surface, wherein the exhaust rotor assembly is rotatably received in the circular through bore of the cylinder head member, wherein the exhaust rotor assembly is coaxially aligned with the circular through bore of the cylinder head member;

wherein the exhaust rotor body includes an area defining a through bore extending therethrough, wherein the through bore of the exhaust rotor body includes a first open end and a spaced and opposed second open end, wherein the first and second exhaust rotor shell portions are in direct opposition to one another so as to envelope a portion of the exhaust rotor body, wherein when the first and second exhaust rotor shell portions are in direct opposition to one another an air gap is formed between opposed edge surfaces of the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions jointly rotate so that the first and second open ends of the through bore of the exhaust rotor body and the ports of the first and second exhaust rotor shell portions are in fluid communication with the first and second exhaust ports.

2. The cylinder head assembly according to claim 1, wherein the semi-circular convex outer surface of each of the first and second intake rotor shell portions are urged outwardly towards or against an interior surface of the circular through bore of the cylinder head member in response to an increase or decrease in pressure of a cylinder in fluid communication with either of the first exhaust port or the first intake port.

3. The cylinder head assembly according to claim 1, wherein the semi-circular convex outer surface of each of the first and second intake rotor shell portions are urged outwardly towards or against an interior surface of the circular through bore of the cylinder head member in response to a gaseous flow from the cylinder in fluid communication with the first exhaust port or the first intake port, so as to create a seal therebetween.

4. The cylinder head assembly according to claim 1, wherein the semi-circular convex outer surface of each of the first and second exhaust rotor shell portions are urged outwardly towards or against an interior surface of the circular through bore of the cylinder head member in response to an increase or decrease in pressure of a cylinder in fluid communication with either of the first exhaust port or the first intake port.

5. The cylinder head assembly according to claim 1, wherein the semi-circular convex outer surface of each of the first and second exhaust rotor shell portions are urged outwardly towards or against an interior surface of the circular through bore of the cylinder head member in response to a gaseous flow from the cylinder in fluid communication with the first exhaust port or the first intake port, so as to create a seal therebetween.

6. The cylinder head assembly according to claim 1, wherein the intake rotor body and the exhaust rotor body include a shaft extending therefrom.

7. The cylinder head assembly according to claim 6, further comprising a shaft interconnection member interconnecting the shaft of the exhaust rotor body and the shaft of the intake rotor body.

8. The cylinder head assembly according to claim 1, further comprising an interconnection member interconnecting the intake rotor body and the exhaust rotor body such that the intake rotor assembly simultaneously rotates with the exhaust rotor assembly.

9. A cylinder head assembly for a cylinder of a four stroke internal combustion engine, comprising:

a lower cylinder head member, wherein the lower cylinder head member includes an area defining a first exhaust port and a first intake port formed therein;

an upper cylinder head member, wherein the upper cylinder head member includes an area defining a second exhaust port and a second intake port formed therein;

wherein the lower and upper cylinder head members are brought into engagement with one another so as to define a through bore therebetween, wherein the first and second exhaust ports are axially aligned with one another when the lower and upper cylinder head members are brought into engagement with one another, wherein the first and second intake ports are axially aligned with one another when the lower and upper cylinder head members are brought into engagement with one another;

a cylindrical housing having an area defining a circular through bore extending therethrough, wherein a first surface of the housing includes an area defining a third exhaust port and a third intake port formed therein, wherein a spaced and opposed second surface of the housing includes an area defining a fourth exhaust port and fourth intake port formed therein, wherein the first, second, third and fourth exhaust ports are axially aligned with one another when the lower and upper cylinder head members and housing are brought into engagement with one another, wherein the first, second, third and fourth intake ports are axially aligned with one another when the lower and upper cylinder head members and housing are brought into engagement with one another;

a cylinder head member, wherein the cylinder head member includes a first area defining a first exhaust port and a first intake port formed on an upper surface thereof, and a second are defining a second exhaust port and a second intake port formed on a lower surface thereof;

wherein the cylinder head member includes an area defining a circular through bore, wherein the first and second exhaust ports are axially aligned with one another and are in fluid communication with the circular through bore, wherein the first and second intake ports are axially aligned with one another and are in fluid communication with the circular through bore;

an intake rotor assembly including an intake rotor body, a first intake rotor shell portion, a second intake rotor shell portion, wherein the first and second intake rotor shell portions include a semi-circular convex outer surface, wherein the intake rotor assembly is rotatably received in the circular through bore of the housing, wherein the intake rotor assembly is coaxially aligned with the circular through bore of the housing;

wherein the intake rotor body includes an area defining a through bore extending therethrough, wherein the through bore of the intake rotor body includes a first open end and a spaced and opposed second open end, wherein the first and second intake rotor shell portions are in direct opposition to one another so as to envelope a portion of the intake rotor body, wherein when the first and second intake rotor shell portions are in direct opposition to one another a non-linear air gap including at least one chamfered surface at a terminal portion is formed on a surface of the first intake rotor shell portion, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions jointly rotate so that the first and second open ends of the through bore of the intake rotor body and the ports of the first and second intake rotor shell portions are in fluid communication with the first, second, third and fourth intake ports; and an exhaust rotor assembly including an exhaust rotor body, a first exhaust rotor shell portion, a second exhaust rotor shell portion, wherein the first and second exhaust rotor shell portions include a semi-circular convex outer surface, wherein the exhaust rotor assembly is rotatably received in the circular through bore of the housing, wherein the exhaust rotor assembly is coaxially aligned with the circular through bore of the housing;

wherein the exhaust rotor body includes an area defining a through bore extending therethrough, wherein the through bore of the exhaust rotor body includes a first open end and a spaced and opposed second open end, wherein the first and second exhaust rotor shell portions are in direct opposition to one another so as to envelope a portion of the exhaust rotor body, wherein when the first and second exhaust rotor shell portions are in direct opposition to one another an air gap is formed between opposed edge surfaces of the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions jointly rotate so that the first and second open ends of the through bore of the exhaust rotor body and the ports of the first and second exhaust rotor shell portions are in fluid communication with the first, second, third and fourth exhaust ports.

10. The cylinder head assembly according to claim 9, wherein at least one of the first and second intake rotor shell portions are operable to be urged outwardly towards or against an interior surface of the circular through bore of the housing in response to an increase or decrease in pressure of the cylinder in fluid communication with either of the first exhaust port or the first intake port.

11. The cylinder head assembly according to claim 9, wherein at least one of the first and second intake rotor shell portions are operable to be urged outwardly towards or against an interior surface of the circular through bore of the housing in response to a gaseous flow from the cylinder in fluid communication with the first exhaust port or the first intake port, so as to create a seal therebetween.

12. The cylinder head assembly according to claim 9, wherein at least one of the first and second exhaust rotor shell portions are operable to be urged outwardly towards or against an interior surface of the circular through bore of the housing in response to an increase or decrease in pressure of the cylinder in fluid communication with either of the first exhaust port or the first intake port.

13. The cylinder head assembly according to claim 9, wherein at least one of the first and second exhaust rotor shell portions are operable to be urged outwardly towards or against an interior surface of the circular through bore of the housing in response to a gaseous flow from the cylinder in fluid communication with the first exhaust port or the first intake port, so as to create a seal therebetween.

14. The cylinder head assembly according to claim 9, wherein the intake rotor body and the exhaust rotor body include a shaft extending therefrom.

15. The cylinder head assembly according to claim 14, further comprising a shaft interconnection member operable to interconnect the shaft of the exhaust rotor body and the shaft of the intake rotor body.

16. The cylinder head assembly according to claim 9, further comprising an interconnection member operable to interconnect the intake rotor body and the exhaust rotor body such that intake rotor assembly simultaneously rotates with exhaust rotor assembly.

17. A cylinder head assembly for a cylinder of a four stroke internal combustion engine, comprising:

a cylinder head member, wherein the cylinder head member includes a first area defining a first intake port formed on a first upper surface thereof and a second intake port formed on a first lower surface thereof, wherein the cylinder head member includes a second area defining a first exhaust port formed on a second upper surface thereof and a second exhaust port formed on a second lower surface thereof;

wherein the cylinder head member includes an area defining a first circular through bore and a second circular through bore, wherein the first and second intake ports are axially aligned with one another and are in fluid communication with the first circular through bore, wherein the first and second exhaust ports are axially aligned with one another and are in fluid communication with the second circular through bore;

an intake rotor assembly including an intake rotor body, a first intake rotor shell portion, a second intake rotor shell portion, wherein the first and second intake rotor shell portions include a semi-circular convex outer surface, wherein the intake rotor assembly is rotatably received in the first circular through bore of the cylinder head member, wherein the intake rotor assembly is coaxially aligned with the first circular through bore of the cylinder head member;

wherein the intake rotor body includes an area defining a through bore extending therethrough, wherein the through bore of the intake rotor body includes a first open end and a spaced and opposed second open end, wherein the first and second intake rotor shell portions are in direct opposition to one another so as to envelope a portion of the intake rotor body, wherein when the first and second intake rotor shell portions are in direct opposition to one another a non-linear air gap including at least one chamfered surface at a terminal portion is formed between opposed edge surfaces of the first and second intake rotor shell portions, wherein a port is formed on a surface of the first intake rotor shell portion, wherein a port is formed on a surface of the second intake rotor shell portion, wherein the port of the first intake rotor shell portion is axially aligned with the first open end of the through bore of the intake rotor body, wherein the port of the second intake rotor shell portion is axially aligned with the second open end of the through bore of the intake rotor body, wherein the intake rotor body and the first and second intake rotor shell portions jointly rotate so that the first and second open ends of the through bore of the intake rotor body and the ports of the first and second intake rotor shell portions are in fluid communication with the first and second intake ports; and an exhaust rotor assembly including an exhaust rotor body, a first exhaust rotor shell portion, a second exhaust rotor shell portion, wherein the first and second exhaust rotor shell portions include a semi-circular convex outer surface, wherein the exhaust rotor assembly is rotatably received in the second circular through bore of the cylinder head member, wherein the exhaust rotor assembly is coaxially aligned with the second circular through bore of the cylinder head member;

wherein the exhaust rotor body includes an area defining a through bore extending therethrough, wherein the through bore of the exhaust rotor body includes a first open end and a spaced and opposed second open end, wherein the first and second exhaust rotor shell portions are in direct opposition to one another so as to envelope a portion of the exhaust rotor body, wherein when the first and second exhaust rotor shell portions are in direct opposition to one another an air gap is formed between opposed edge surfaces of the first and second exhaust rotor shell portions, wherein a port is formed on a surface of the first exhaust rotor shell portion, wherein a port is formed on a surface of the second exhaust rotor shell portion, wherein the port of the first exhaust rotor shell portion is axially aligned with the first open end of the through bore of the exhaust rotor body, wherein the port of the second exhaust rotor shell portion is axially aligned with the second open end of the through bore of the exhaust rotor body, wherein the exhaust rotor body and the first and second exhaust rotor shell portions jointly rotate so that the first and second open ends of the through bore of the exhaust rotor body and the ports of the first and second exhaust rotor shell portions are in fluid communication with the first and second exhaust ports.

18. The cylinder head assembly according to claim 17, wherein at least one of the first and second intake rotor shell portions are operable to be urged outwardly towards or against an interior surface of the first circular through bore of the cylinder head member in response to an increase or decrease in pressure of a cylinder in fluid communication with either of the first exhaust port or the first intake port, or in response to a gaseous flow from the cylinder in fluid communication with the first exhaust port or the first intake port, so as to create a seal therebetween.

19. The cylinder head assembly according to claim 17, wherein at least one of the first and second exhaust rotor shell portions are operable to be urged outwardly towards or against an interior surface of the second circular through bore of the cylinder head member in response to an increase or decrease in pressure of a cylinder in fluid communication with either of the first exhaust port or the first intake port, or in response to a gaseous flow from the cylinder in fluid communication with the first exhaust port or the first intake port, so as to create a seal therebetween.

20. The cylinder head assembly according to claim 17, wherein the intake rotor body and the exhaust rotor body include a shaft extending therefrom, wherein a shaft interconnection member operable to interconnect the shaft of the exhaust rotor body and the shaft of the intake rotor body.

* * * * *